US011545331B2

(12) United States Patent
Shirota et al.

(10) Patent No.: US 11,545,331 B2
(45) Date of Patent: Jan. 3, 2023

(54) X-RAY IMAGING APPARATUS

(71) Applicant: Shimadzu Corporation, Kyoto (JP)

(72) Inventors: Ken Shirota, Kyoto (JP); Haruo Uno, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/223,625

(22) Filed: Apr. 6, 2021

(65) Prior Publication Data

US 2021/0313136 A1 Oct. 7, 2021

(30) Foreign Application Priority Data

Apr. 7, 2020 (JP) ..... JP2020-068930

(51) Int. Cl.
*H01J 35/10* (2006.01)
*H05G 1/54* (2006.01)
*H05G 1/66* (2006.01)

(52) U.S. Cl.
CPC ..... *H01J 35/101* (2013.01); *H05G 1/54* (2013.01); *H05G 1/66* (2013.01); *H01J 2235/1093* (2013.01)

(58) Field of Classification Search
CPC .. H01J 35/101; H01J 2235/1093; H05G 1/54; H05G 1/66
See application file for complete search history.

(56) References Cited

FOREIGN PATENT DOCUMENTS

| | | | | |
|---|---|---|---|---|
| JP | 2000173796 A | * | 6/2000 | |
| JP | 2014-191935 A | | 10/2014 | |
| WO | WO-2010061809 A1 | * | 6/2010 | ..... A61B 6/032 |

* cited by examiner

*Primary Examiner* — Chih-Cheng Kao
(74) *Attorney, Agent, or Firm* — Muir Patent Law, PLLC

(57) ABSTRACT

The X-ray imaging apparatus includes: a main power supply operation unit for switching ON/OFF of power supply to the X-ray imaging apparatus; a braking unit for decelerating a rotation speed of the anode to a predetermined braking speed lower than a resonance range which is a rotation speed of the anode at which resonance occurs in the X-ray tube; and a non-braking stop prediction unit configured to detect a predetermined situation in which a non-braking stop state is predicted, the non-braking stop state being a state in which the main power supply operation unit is operated to be turned to an OFF state without decelerating the rotating anode by the braking unit. The non-braking stop prediction unit activates the braking unit by detecting the predetermined situation to decrease the rotation speed of the anode to the braking speed.

7 Claims, 16 Drawing Sheets

X-RAY IMAGING APPARATUS

CROSS-REFERENCE TO RELATED APPLICATIONS

This application claims priority under 35 U.S.C. § 119 to Japanese Patent Application No. 2003-068930 filed on Apr. 7, 2020, the entire disclosure of which is incorporated herein by reference in its entirety.

TECHNICAL FIELD

The present invention relates to an X-ray imaging apparatus, and more particularly to a technique for preventing degradation of an X-ray tube.

BACKGROUND OF THE INVENTION

As a configuration for generating X-rays in an X-ray imaging apparatus, a rotary anode type X-ray tube is generally used in which the anode is rotated at a predetermined speed (e.g., 180 Hz) which is relatively high and an electron-beam is emitted from the cathode to the anode rotating at a high speed. In a conventional rotary anode type X-ray tube, each time the X-ray imaging is completed, the rotation speed of the anode is decreased by decreasing the rotation of the anode (e.g., Document 1).

PRIOR ART DOCUMENT

Patent Document

Patent Document 1: Japanese Unexamined Patent Application Publication No. 2014-191935

SUMMARY OF THE INVENTION

Problems to be Solved by the Invention

However, the conventional example having the above-described configuration has the following problems.

In the conventional configuration, each time the generation of X-rays is started, it is required to accelerate the rotation speed of the anode to a predetermined speed, and the acceleration takes a few seconds or so. Therefore, in a case where an operation (X-ray imaging) for generating X-rays from the X-ray tube is performed successively for a plurality of times, the anode rotation needs to be re-accelerated each time when generating X-rays. Therefore, the time required for performing successive X-ray imaging for a plurality of times is prolonged.

As a new X-ray tube control method for shortening the time required for performing such successive X-ray imaging several times, the following method can be exemplified. After accelerating the rotation speed of the anode to a predetermined speed, the rotation speed of the anode is maintained at the predetermined speed for a certain time, regardless of whether or not an X-ray generating operation is performed. In this new control method, even in the case of performing the operation of generating X-rays multiple times at short intervals from the X-ray tube, there is no need to wait for the re-acceleration of the anode rotation each time the operation of generating X-rays is performed. Therefore, successive X-ray imaging over a plurality of times can be performed in a short time.

However, with this configuration in which the high speed rotation of the anode of the X-ray tube is maintained for a certain period of time, there arises a new concern that the X-ray tube will deteriorate prematurely.

The present invention has been made in view of the above-described circumstances, and an object thereof is to provide an X-ray imaging apparatus capable of performing a plurality of successive X-ray imaging operations in a short time and more assuredly preventing deterioration of an X-ray tube.

Means for Solving the Problem

In order to solve the above-described problem, the inventors of the present invention have studied, and as a result, the following findings have been obtained. That is, since the rotation of an anode is maintained at a high speed for a certain period of time, a situation may occur in which an operator turns off the power of the X-ray device main body in a state in which the high-speed rotation is maintained.

In an X-ray tube, when an anode is being rotated at a specific rotation speed (e.g., 70 Hz to 90 Hz) called "resonance range", the entire X-ray tube largely vibrates by the resonant effect. So, the X-ray tube, particularly the support portion of the rotating anode, is likely to be deteriorated. When the rotation speed of the anode is decreased rapidly by the operation of a braking mechanism, the time during which the rotation speed of the anode reaches the resonance range becomes short. Therefore, the impact on the X-ray tube is small.

On the other hand, when the power supply of the X-ray device main body is turned off, the braking mechanism with respect to the rotating anode is also turned off. Therefore, the anode rotating at high speed gradually decreases by inertia. Therefore, when the anode decelerates by inertia, the time that the rotation speed of the anode reaches the resonant point becomes very long. The long-term resonance of the X-ray tube causes the abrasion of each component of the X-ray tube exemplified by a bearing, resulting in the premature degradation of the X-ray tube.

The present invention has been made to solve the above-described objects and has the following configuration. That is, the present invention is directed to an X-ray imaging apparatus provided with a cathode, an anode, a rotation drive unit for rotating the anode to a predetermined operation speed, and an X-ray tube for emitting X-rays from the anode toward a subject by applying a high voltage between the cathode and the anode, the anode being rotated at the predetermined operation speed. The X-ray imaging apparatus includes: a main power supply operation unit configured to switch ON/OFF of power supply to the X-ray imaging apparatus; a braking unit configured to decrease a rotation speed of the anode to a braking speed lower than a resonance speed that is a rotation speed of the anode at which resonance occurs in the X-ray tube; and a non-braking stop prediction unit configured to detect a predetermined situation in which a non-braking stop state is predicted, the non-braking stop state being a state in which the main power supply operation unit is operated to be turned to an OFF state without decelerating the rotating anode by the braking unit. The non-braking stop prediction unit activates the braking unit by detecting the predetermined situation to decrease the rotation speed of the anode to the braking speed.

In this configuration, the non-braking stop prediction unit detects a predetermined situation in which a non-braking stop state is predicted. The non-braking stop state is a state in which the main power supply operation unit is operated to be turned to the OFF state without decelerating the rotating anode by the braking unit. When the predetermined situation in which the non-braking stop state is predicted is detected, the non-braking stop prediction unit activates the braking unit to decrease the rotation speed of the anode to the braking speed.

The braking speed is a speed predetermined as a speed lower than the resonance speed. The resonance speed is a rotation speed of the anode at which resonance occurs in the X-ray tube. That is, by decreasing the rotation speed of the anode to the braking speed by the non-braking stop prediction unit, even in a case where the non-braking stop state occurs, the rotation speed of the anode becomes the braking speed quickly. Thus, it can be avoided that the rotation speed of the anode remains at the resonance speed for a long time. Therefore, even in the case of the configuration in which the anode is kept being rotated at a high speed for a certain period of time, it is possible to prevent the occurrence of the non-braking stop state. As a result, it is possible to perform successive generation of X-rays in a short time and more assuredly prevent degradation of the X-ray tube due to resonance Further, in the above-described invention, preferably, the non-braking stop prediction unit is provided with an error detection unit for detecting an error generated in the X-ray imaging apparatus, and the error detection unit activates the braking unit by detecting an occurrence of the error to decrease the rotation speed of the anode to the braking speed.

[Function and Effect]

According to the X-ray imaging apparatus of the present invention, the non-braking stop prediction unit is provided with an error detection unit for detecting an error generated in the X-ray imaging apparatus. The error detection unit activates the braking unit by detecting an occurrence of the error to decrease the rotation speed of the anode to the braking speed. When an error occurs, it is possible to predict the occurrence of the situation in which the operator operates the main power supply operation unit to be turned to the OFF-state without activating the braking unit. For this reason, by configuring such that when the error detection unit detects the generation of an error, the drive unit automatically decreases the rotation speed of the anode to the braking speed. With this, it is possible to prevent the deterioration of the X-ray tube due to the occurrence of the non-braking stop state.

Further, in the above-described invention, preferably, the X-ray imaging apparatus is provided with an examination end instruction unit configured to input an end instruction of an examination of a subject. The non-braking stop prediction unit includes an examination end detection unit for detecting the input by the examination end instruction unit, and the examination end detection unit activates the braking unit by detecting the input by the examination end instruction unit and decreases the rotation speed of the anode to the braking speed.

[Function and Effect]

According to the X-ray imaging apparatus of the present invention, the non-braking stop prediction unit is provided with an examination end detection unit for detecting that an instruction to end the examination is input to the subject. The examination completion detection unit activates the drive unit by detecting the input by the examination end instruction unit and decreases the rotation speed of the anode to the braking speed. When an instruction to end the examination of the subject is input, it is possible to predict the situation in which the operator operates the main power supply operation unit to be turned to the OFF state without activating the braking unit. For this reason, by configuring such that when the examination end detection unit detects the instruction to end the examination, the drive unit automatically decreases the rotation speed of the anode to the braking speed, it is possible to prevent the deterioration of the X-ray tube due to the occurrence of the non-braking stop state.

Further, in the above-described invention, preferably, the X-ray imaging apparatus further includes: a timer configured to detect a rotation start time and a braking completion time, the rotation start time being a time at which the anode starts rotating by the rotation drive unit, and the braking completion time being a time at which the rotation speed of the anode is decreased to the braking speed by the braking unit; and a storage unit configured to overwrite and store the rotation start time and the braking completion time detected by the timer. The non-braking stop prediction unit is provided with an operation time detection unit configured to determine which of the rotation start time and the braking completion time is earlier when the main power supply operation unit is operated to be turned to an ON state. The operation time detection unit activates the braking unit when it is determined that the rotation start time is earlier than the braking completion time to decrease the rotation speed of the anode to the braking speed.

[Function and Effects]

According to the X-ray imaging apparatus of the present invention, it is provided with an operation time detection unit for determining which of the rotation start time and the braking completion time is earlier when the main power supply operation unit is operated to be turned to the ON state. The operation time detection unit activates the drive unit when it is determined that the rotation start time is earlier than the braking completion time and decreases the rotation speed of the anode to the braking speed.

The rotation start time is overwritten and stored in the storage unit as the time at which the anode begins to rotate. The braking completion time is overwritten and stored in the storage unit as the time at which the rotation speed of the anode is decreased to the braking speed. Therefore, when the rotation start time is earlier than the braking completion time, it is predicted that the non-braking stop state will occur. Therefore, in a case where the operation time detection unit determined that the rotation start time is earlier than the braking completion time, the drive unit automatically decreases the rotation speed of the anode to the braking speed. Therefore, it is possible to prevent the deterioration of the X-ray tube due to the occurrence of the non-braking stop state.

Further, in the above-described invention, preferably, the X-ray imaging apparatus further includes: a stop time measurement means configured to measure a stop time, the stop time being a time from a time at which the main power supply operation unit is operated to be turned to an OFF state to a stop time at which the main power supply operation unit is next operated to be turned to an ON state. The non-braking stop prediction unit is provided with a stop time determination unit configured to determine which of a resonance speed reach time and the stop time is longer when the main power supply operation unit is operated to be turned to the ON state, the resonance speed reach time being a time required to decrease the rotation speed of the anode from the operation speed to the resonance speed without activating the braking unit by inertia. The stop time determination unit activates the braking unit when it is determined that the resonance speed reach time is longer than the stop time to decrease the rotation speed of the anode to the braking speed.

[Function and Effects]

According to the X-ray imaging apparatus of the present invention, it is provided with a stop time determination unit for determining which of the resonance speed reach time and the stop time is longer when the main power supply operation unit is operated to be turned to the ON state. The stop time determination unit activates the drive unit when it is determined that the resonance speed reach time is longer than the stop time and decreases the rotation speed of the anode to the braking speed.

The resonance speed reach time is predetermined as a time required for the rotation speed of the anode to reach the resonance speed from the operation speed without activating the braking unit. Therefore, when the resonance speed reach time is longer than the stop time, it is predicted that the non-braking stop state will occur. Therefore, when the stop time determination unit is determined that the resonance speed reach time is longer than the stop time, the driving unit automatically decreases the rotation speed of the anode to the braking speed. Therefore, it is possible to prevent the deterioration of the X-ray tube due to the occurrence of the non-braking stop state.

Effects of the Invention

According to the X-ray imaging apparatus of the present invention, it is further provided with a non-braking stop prediction unit for detecting a predetermined situation in which the non-braking stop state is predicted. When the predetermine situation in which the on-braking stop state is predicted, the non-braking stop prediction unit activates the braking unit to decrease the rotation speed of the anode to the braking speed. The non-braking stop state is a state in which the main power supply operation unit is operated to be turned to the OFF state without decelerating the rotating anode by the braking unit.

The braking speed is a speed predetermined as a speed slower than the resonance speed, and the resonance speed is a rotation speed of the anode at which resonance occurs in the X-ray tube. That is, by decreasing the rotation speed of the anode by the non-braking stop prediction unit to the braking speed, even in a case where a non-braking stop state occurs, the rotation speed of the anode quickly reaches the baking speed. Therefore, it is possible to prevent that the rotation speed of the anode remains at the resonance speed for a long time. Therefore, even in a configuration in which the anode is kept rotated at a high speed for a certain period of time, it is possible to prevent the occurrence of the non-braking stop state. Thus, it is possible to successively generate X-rays in a short time, and it is also possible to more assuredly prevent the degradation of the X-ray tube due to resonance.

EMBODIMENTS FOR CARRYING OUT THE INVENTION

Hereinafter, some embodiments of the present invention will be described with reference to the attached drawings.

<Description of Overall Configuration>

Figure 1:
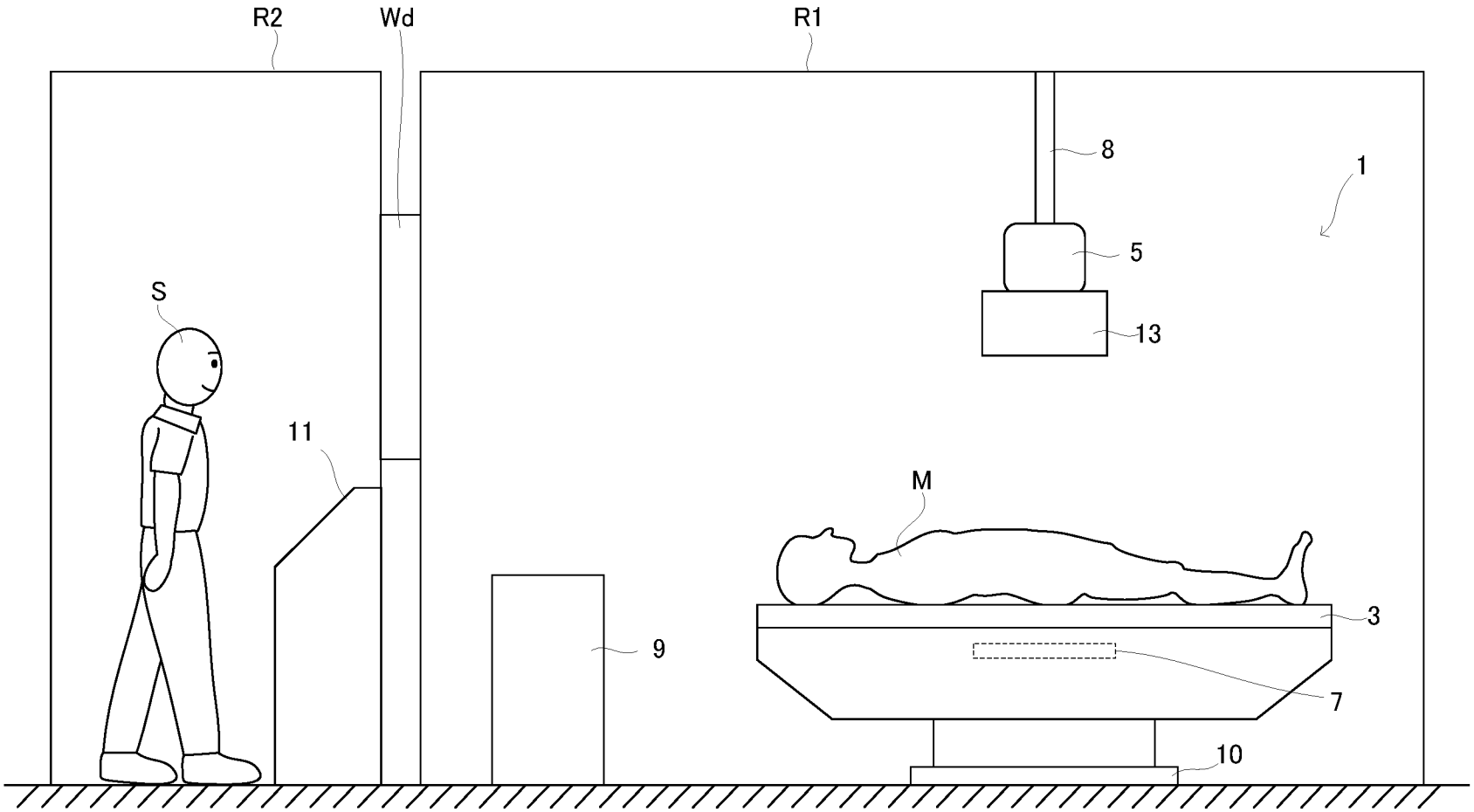
FIG. 1 is a front view for explaining the entire configuration of an X-ray imaging apparatus according to an example.

An X-ray imaging apparatus 1 according to an embodiment is provided with, as shown in FIG. 1, a top board 3, an X-ray tube 5, an X-ray detector 7, a control device 9, and an input device 11. The top board 3, the X-ray tube 5, the X-ray detector 7, and the control device 9 are arranged in an imaging room R1. The input device 11 is arranged in an operation room R2.

The top board 3 is configured to place a subject M thereon in a horizontally oriented posture. The top board 3 is supported by a base 4 disposed on the floor and is configured to be in a liftable and lowerable manner. The X-ray tube 5 is configured to emit X-rays to the subject M and is supported in a suspended manner by a support member 8 suspended from the ceiling. The support member 8 is configured to be horizontally movable along the ceiling of the imaging room R1. The X-ray tube 5 can move horizontally in accordance with the support member 8. Further, the X-ray tube 5 is configured to be movable in a liftable and lowerable manner along the support member 8.

A collimator 13 is provided at the lower portion of the X-ray tube 5. The collimator 13 restricts the X-rays emitted from the X-ray tube 5 to a predetermined form. For example, the predetermined shape is a cone shape having a pyramid. The X-ray detector 7 detects the X-rays emitted from the X-ray tube 5 and converts them into an electric signal. The X-ray tube 5 and the X-ray detector 7 are arranged to face each other across the top board 3.

Figure 2:
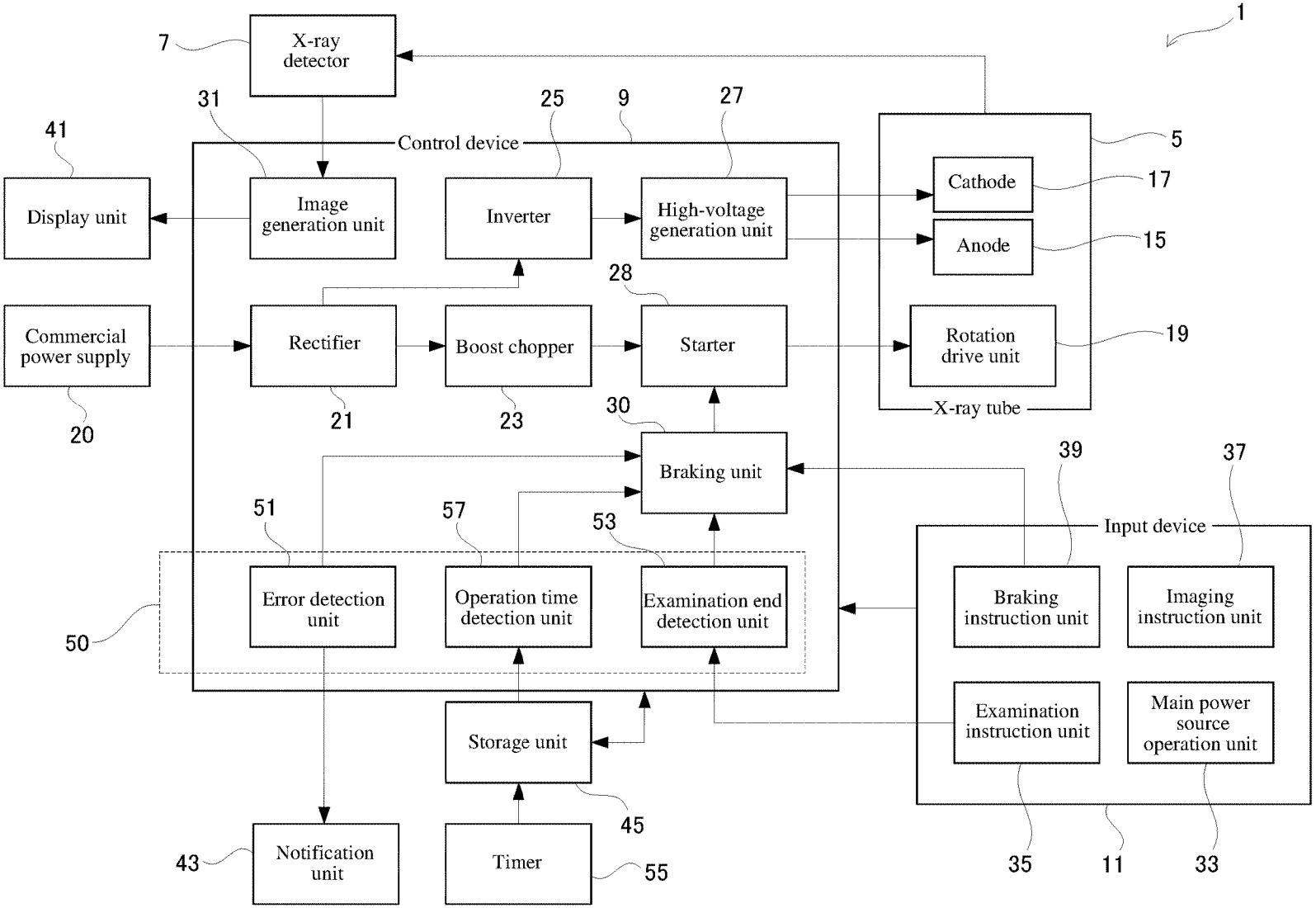
FIG. 2 is a functional block diagram for explaining the configuration of the X-ray imaging apparatus according to the example.

The X-ray tube 5 is provided with, as shown in FIG. 2, an anode 15, a cathode 17, and a rotation drive unit 19. The anode 15 and the cathode 17 are oppositely disposed inside a tube (not shown). The rotation drive unit 19 rotates the anode 15. As an exemplary configuration of the rotation drive unit 19, a rotor connected to the anode 15 and a stator coil for rotating the rotor by generating an alternating magnetic field of two phases are exemplified. The configuration of the rotation drive unit 19 is not particularly limited as long as it is configured to rotate the anode 15.

The control device 9 includes, for example, an information processing unit, such as, e.g., a central processing unit (CPU: Central Processing Unit). The control device 9 collectively controls the operation of each part constituting the X-ray imaging apparatus 1, such as, e.g., the top board 3, the X-ray tube 5, and the X-ray detector 7.

The control device 9 includes a rectifier 21, a boost chopper 23, an inverter 25, a high-voltage generation unit 27, a starter 28, a braking unit 30, and an image generation unit 31. The rectifier 21 is electrically connected to the commercial power supply 20 and converts the power supplied from the commercial power supply 20 from AC to DC. The boost chopper 23 boosts the voltage converted by the rectifier 21. The boosted voltage is applied to the inverter 25 and the starter 28.

The inverter 25 performs the AC-DC conversion of the voltage applied from the boost chopper 23 and supplies the converted voltage to a high-voltage generation unit 27. The high-voltage generation unit 27 applies the supplied voltage between the anode 15 and the cathode 17. When a voltage is applied between the anode 15 and the cathode 17 in a state in which the anode 15 is being rotated, an electron beam is emitted from the cathode 17 to the anode 15, so that X-rays are generated in the anode 15.

The starter 28 generates a two-phase AC power having a predetermined voltage and a predetermined frequency and supplies the AC power to the rotation drive unit 19. By supplying the AC power to the rotation drive unit 19, the rotation drive unit 19 can rotate the anode 15 at any rotation speed.

The braking unit 30 decreases the rotation speed of the anode 15 by the rotation drive unit 19 by controlling the AC power generated by the starter 28. By decelerating the anode 15 by the braking unit 30, the rotation speed of the anode 15 becomes the braking speed F1 or less. The braking speed F1 is a predetermined rotation speed lower than the resonance range F3, in other words, a rotation speed that can assuredly avoid the resonance of the X-ray tube 5. In this example, it is assumed that the braking speed F1 is 60 Hz. The resonance range F3 is a range of the rotation speed of the anode 15 in which a resonant effect acts on the X-ray tube 5. In this example, it is assumed that 70 Hz or more and 90 Hz or less are the resonance range F3.

The braking unit 30 is not limited to the configuration for controlling the starter 28 and may be appropriately changed as long as it is configured to decrease the rotation speed of the anode 15. As another configuration of the braking unit 30, a configuration for decelerating or stopping the operation of the rotation drive unit 19 can be exemplified. The image generation unit 31 is provided at the subsequent stage of the X-ray detector 7 and generates an X-ray image by performing various image processing based on the X-ray detection signal output from the X-ray detector 7.

The input device 11 is configured to input an instruction of an operator S. The example thereof includes a keyboard-input panel, a touch-input panel, a push-button switch, and a switching-type switch. The operator S performs various instructions to the X-ray imaging apparatus 1 by appropriately operating the input device 11 while confirming the subject M, etc., through the window Wd from the operation room R2.

The input device 11 includes a main power supply operation unit 33, an examination instruction unit 35, an imaging instruction unit 37, and a braking instruction unit 39. The main power supply operation unit 33 is a switching-type switch, for example, to control the ON/OFF of the power supply for the entire X-ray imaging apparatus 1. The examination instruction unit 35 is, for example, an icon arranged on a touch panel and is configured to input an instruction of the operator S relating to the start and end of the examination of the subject M.

The imaging instruction unit 37 enters an instruction related to the preparation and the start of the X-ray imaging by the X-ray imaging apparatus 1. In this example, the imaging instruction unit 37 is composed of a push-button switch which is pressed in two stages. By performing the first stage pressing operation with respect to the imaging instruction unit 37, the rotation speed of the anode 15 is increased to the operation speed F2. Note that the operation speed F2 is a rotation speed of the anode 15 required for generating X-rays and is, for example, 180 Hz. In a state in which the rotation speed of the anode 15 is at the operation speed F2, the X-ray imaging is performed by performing the second stage pressing operation with respect to the imaging instruction unit 37.

The braking instruction unit 39 is, for example, a push-button switch. By operating the braking instruction unit 39, the braking unit 30 is activated. That is, the operator S can decrease the rotation speed of the anode 15 at any timing by operating the braking instruction unit 39 to be turned to the ON state.

The X-ray imaging apparatus 1 is further provided with a display unit 41, a notification unit 43, a storage unit 45, and a timer 55. The display unit 41 is, for example, a high-quality monitor arranged in the operation room R2 and displays an X-ray image generated by the image generation unit 31. The notification unit 43 notifies each part state constituting the X-ray imaging apparatus 1 of the operator S. As an example of the notification method by the notification unit 43, a configuration in which the notification is performed by voice or light is exemplified. The storage unit 45 stores various types of information acquired in the X-ray imaging apparatus 1, the information being exemplified by X-ray images generated by the image generation unit 31.

The timer 55 is configured to measure the time at which various operations are performed in the X-ray imaging apparatus 1. For example, it detects the time at which the anode 15 starts rotating (the time at which the first stage operation of the imaging instruction unit 37 is performed) is detected as a rotation start time B1. Further, the timer 55 detects the time at which the rotation speed of the anode 15 has reached the braking speed F1 by the activation of the braking unit 30, as a braking completion time B2. The information on the rotation start time B1 and the information on the braking completion time B2 detected by the timer 55 are transmitted to the storage unit 45. The information on the rotation start time B1 and the information on the braking completion time B2 are overwritten and stored each time the information is transmitted to the storage unit 45.

The X-ray imaging apparatus 1 according to the present invention is provided with, as a configuration for preventing that the X-ray tube 5 resonates for a long time, a non-braking stop prediction unit 50 in the control device 9. The non-braking stop prediction unit 50 detects a situation in which the occurrence of a non-braking stop state is predicted and automatically activates the braking unit 30 when the situation is detected to thereby prevent the X-ray tube 5 from resonating for a long time. The detailed description of the non-braking stop state will be described later. In this embodiment, the non-braking stop prediction unit 50 is provided with an error detection unit 51, an examination end detection unit 53, and an operation time detection unit 57.

The error detection unit 51 is connected to the braking unit 30 and the notification unit 43 to detect various errors generated in the X-ray imaging apparatus 1. For example, the error includes the operation error of the drive device for moving the top board 3 or the support member 8. When the error detection unit 51 detects an error, it transmits the error information to the notification unit 43 and transmits a signal for decreasing the rotation speed of the anode 15 to the braking unit 30.

The examination end detection unit 53 is provided downstream of the examination instruction unit 35. When an instruction that the examination of the subject M has been completed is input by the examination end detection unit 53, the examination end detection unit 53 detects the instruction and transmits a signal for decreasing the rotation speed of the anode 15 to the braking unit 30.

The operation time detection unit 57 reads out the information on the rotation start time B1 and the information on the braking completion time B2 stored in the storage unit 45 and compares these times. When the braking completion time B2 is earlier than the rotation start time B1, the operation time detection unit 57 transmits a signal for decreasing the rotation speed of the anode 15 to the braking unit 30.

<Basic Operation of X-Ray Imaging Apparatus>

Figure 3:
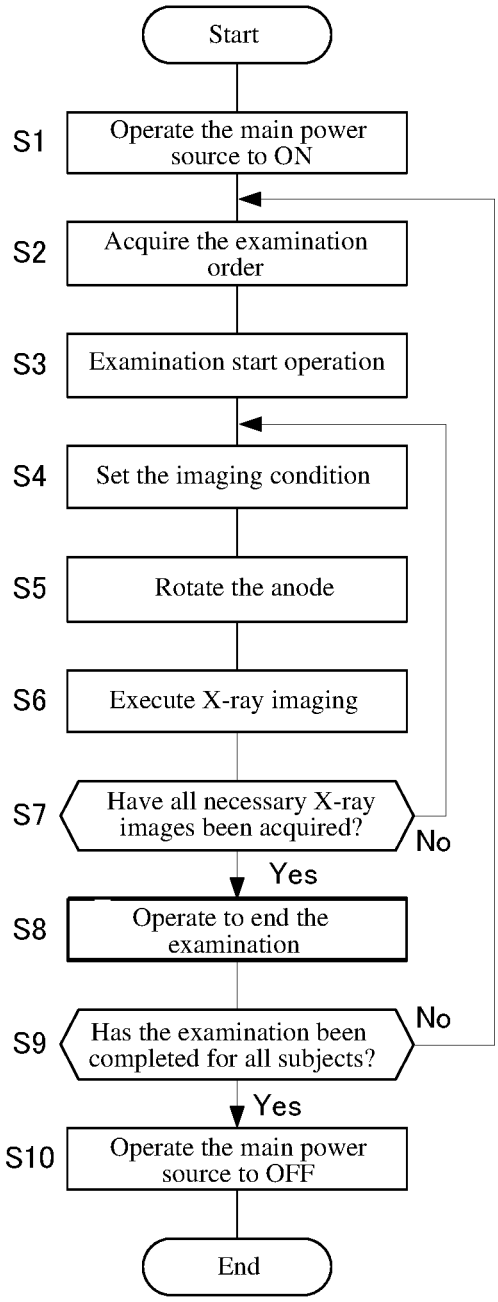
FIG. 3 is a flowchart for explaining the main operation of the X-ray imaging apparatus according to the example.

Here, the basic operation for performing the X-ray imaging by the X-ray imaging apparatus 1 will be described with reference to the flowchart shown in FIG. 3 and the timing chart shown in FIG. 4. First, the operator S operates the main power supply operation unit 33 to be turned to the ON state (Step S1). When the main power supply operation unit 33 is turned to the ON state, power is supplied to each part constituting the X-ray imaging apparatus 1, such as, e.g., the X-ray tube 5, the X-ray detector 7, the control device 9, and various drive devices.

Next, the operator S operates the input device 11 to acquire an examination order from an HIS (Hospital Information System) and an RIS (Radiology Information System) via a network (Step S2).

The operator S selects the examination information on the subject M to be subjected to X-ray imaging from the acquired examination order and inputs an instruction that the examination of the subject M is started in accordance with the examination information by the examination instruction unit 35 (Step S3).

After inputting the examination start instruction, the imaging condition is set (Step S4). The operator S enters the imaging room R1, places a subject M on the top board 3 in an appropriate posture, and makes the collimator 13 emit visible light to confirm the range and the position of the X-ray irradiation field. Then, the operator S returns to the operation room R2 to operate the input device 11 to set the X-ray imaging conditions, such as, e.g., the tube voltage and the tube current to be applied to the X-ray tube 5.

When the X-ray imaging condition is set, the operator S makes the anode 15 rotate by performing the first stage oppressing operation while grasping the imaging instruction unit 37 (Step S5). By the first stage pressing operation, predetermined driving power is applied from the starter 28 to the rotation drive unit 19. The application of the drive power causes the rotation drive unit 19 to increase the rotation speed of the anode 15 to the operation speed F2, as indicated by the reference numeral P1 in FIG. 4. At this time, the rotation speed of the anode 15 is accelerated to the operation speed F2 (180 Hz in this example) in a short time (e.g., about 2 seconds). The rotation of the anode 15 at the operation speed F2 enables the generation of X-rays from the X-ray tube 5.

The timer 55 detects the time at which the first stage pressing operation is performed and overwrites and stores the time as a rotation start time B1 in the storage unit 45. The timer 55 also detects the time at which the rotation speed of the anode 15 has reached the operation speed F2. From when the rotation speed of the anode 15 has reached the operation speed F2 until when a predetermined time DP, which has been determined in advance, has elapsed, the anode 15 rotates while maintaining the operation speed F2.

After the reach of the rotation speed of the anode 15 to the operation speed F2, X-ray imaging is performed (Step S6). That is, at the timing indicated by the reference numeral T1, the operator S performs a second stage pressing operation to the imaging instruction unit 37. By performing the second stage pressing operation, predetermined power is output from the inverter 25 to the high-voltage generation unit 27 in the control device 9. The high-voltage generation unit 27 applies a high voltage between the anode 15 and the cathode 17 depending on the output. The application of the high voltage causes the cathode 17 to emit an electron beam to the rotating anode 15. Thus, X-rays are generated.

The X-rays generated in the anode 15 are limited to the X-ray irradiation field in which the irradiation field is determined in Step S4 by the collimator 13 and are emitted to the subject M. The X-rays transmitted through the subject M are detected by the X-ray detector 7 and converted into an X-ray detection signal. The X-ray image is generated by performing image processing based on the X-ray detection signal by the image generation unit 31. Thus, by performing the second stage pressing operation to the imaging instruction unit 37, X-ray imaging is performed.

Note that when the second stage operation of the imaging instruction unit 37 is performed, the measurement of the predetermined time DP during which the operation speed F2 is maintained is updated. That is, the timer 55 detects the timing T1 at which the second stage operation is performed and updates the starting point of the predetermined time DP to the timing T1. By this updating, the rotation speed of the anode 15 is maintained at the operation speed F2 until the predetermined time DP has elapsed from the timing T1.

The operator S confirms the X-ray image using the display unit 41 or the like and determines whether or not to further perform X-ray imaging (Step S7). When X-ray imaging is to be performed again, the process returns to Step S4, and an X-ray imaging condition related to new X-ray imaging is set.

Note that the anode 15 rotates while maintaining the operation speed F2 from when the timing T1 at which the X-ray imaging is most recently performed to when the predetermined time DP has elapsed. Therefore, the operator S operates the imaging instruction unit 37 to the second stage by setting the X-ray imaging condition before the predetermined time DP has elapsed (see the reference numeral T2 in FIG. 4). In this instance, there is no need to wait for the anode 15 to be accelerated to the operation speed F2 because the anode 15 is maintaining the operation speed F2 without decelerating it. Therefore, X-ray imaging can be performed again by quickly emitting an electron-beam from the cathode 17 to the anode 15. The timer 55 detects the timing T2 and updates the starting point of the predetermined time DP to the timing T2.

Thereafter, in a case where the predetermined time DP has elapsed from the timing T2 at which X-ray imaging was most recently performed without performing the operation of the imaging instruction unit 37, the braking unit 30 is activated in the control device 9. The braking unit 30 decelerates the rotation of the rotor in the rotation drive unit 19 by controlling the starter 28. With this control, the rotation speed of the anode 15 is rapidly decreased from the operation speed F2 to the braking speed F1 (see the reference numeral P2 in FIG. 4). When the rotation speed of the anode 15 is decreased to the braking speed F1, the control by the braking unit 30 is released. Thus, the anode 15 is slowly decelerated from the braking speed F1 by inertia and stops (see the reference numeral P3).

The timer 55 detects the time at which the operation of the braking unit 30 has started and also detects the time at which the rotation speed of the anode has been decreased to the braking speed F1 by the operation of the braking unit 30 as a braking completion time B2. The detected braking completion time B2 is overwritten and stored in the storage unit 45. Note that even before the predetermined time DP has elapsed, by operating the braking instruction unit 39 provided in the input device 11 by the operator S, it is possible to quickly decrease the rotation speed of the anode 15 by activating the braking unit 30 at any timing to the braking speed F1.

On the other hand, when all of X-ray imaging required for the subject M has been completed, the operator S operates the examination instruction unit 35 of the input device 11 and inputs an examination end instruction (Step S8). When the examination end instruction is input, the information, such as, e.g., X-ray images acquired by the X-ray imaging, is transmitted to a server of a hospital via a network (not shown).

After performing the examination of the subject M, the process branches depending on whether or not all of the examinations of the subject have been completed (Step S9). When an examination is performed to another subject, the process returns to Step S2, and the examination information on another subject is selected from an examination order.

When examinations of all of the subjects have been completed in Step S9, the operator S operates the main power supply operation unit 33 to be turned to the OFF state (Step S10). When the main power supply operation unit 33 is turned to the OFF state, the power supply to the X-ray imaging apparatus 1 is stopped. With the above-described operation, all of the steps of the basic operations according to the X-ray imaging apparatus 1 are completed.

<Description of Control to Prevent Resonance>

Here, in the X-ray imaging apparatus 1 according to the example, the control mechanisms for preventing the resonance of the X-ray tube 5 will be described. First, the situation in which the X-ray tube 5 resonates will be described using the timing chart shown in FIG. 4 and the timing chart shown in FIG. 5.

Figure 4:
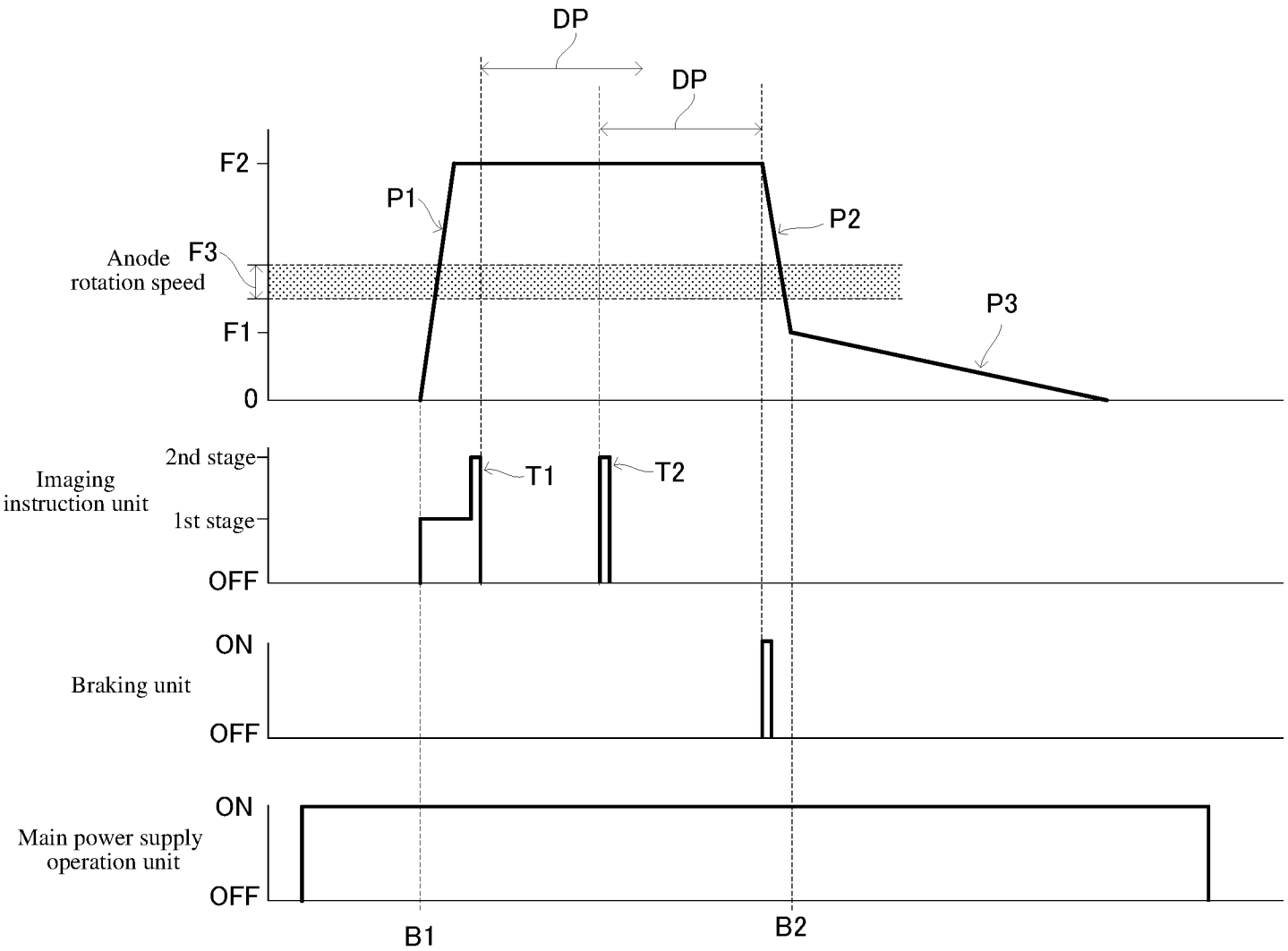
FIG. 4 is a timing chart showing the state in which the braking unit is activated in the X-ray imaging apparatus according to the example.

When the braking unit 30 is activated in a state in which the anode 15 is rotating at the operation speed F2, the rotation speed of the anode 15 is rapidly decreased to the braking speed F1 (see FIG. 4, the reference numeral P2). The braking speed F1 is a speed lower than the resonance range F3. When the braking unit 30 is activated, the time required for the deceleration to the braking speed F1 is, for example, as short as 2 seconds to 3 seconds. Therefore, when the braking unit 30 is activated, the time during which the X-ray tube 5 resonates due to the falling of the rotation speed of the anode 15 in the resonance range F3 is very short. Therefore, the impact on the X-ray tube 5 by the resonance is small.

Figure 5:
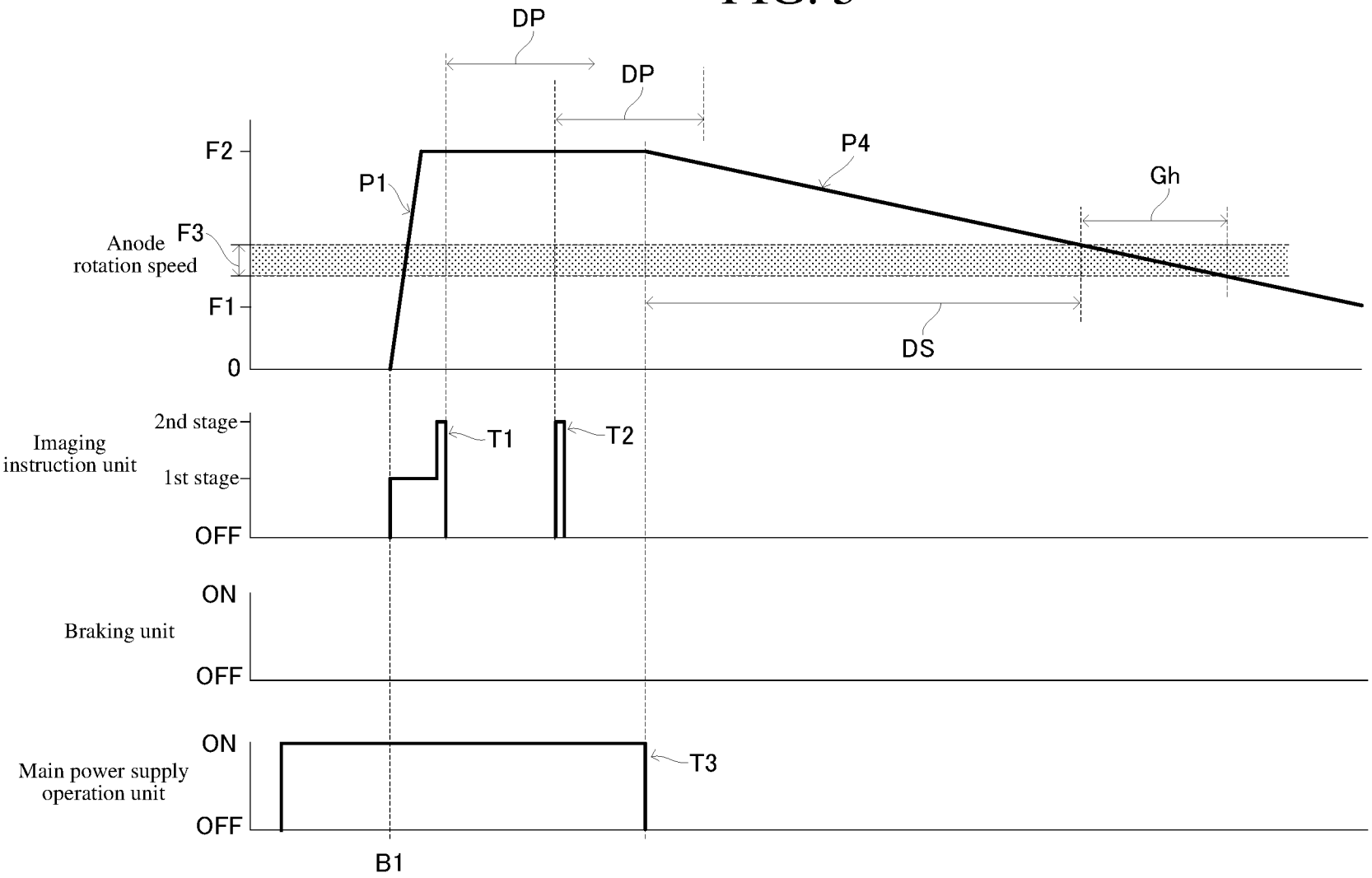
FIG. 5 is a timing chart showing the state in which the main power supply operation unit is turned OFF without activating the braking unit in the X-ray imaging apparatus according to the example.

On the other hand, as shown in FIG. 5, when the main power supply operation unit 33 is operated to be turned to the OFF state in a state in which the rotation speed of the anode 15 is maintaining the operation speed F2 (see the reference numeral T3), the impact on the X-ray tube 5 by the resonance becomes larger. That is, when the main power supply operation unit 33 is operated to be turned to the OFF state, the power supply to the braking unit 30 is also stopped. Thus, the braking unit 30 is operated to be turned to the OFF state before the operation of the braking unit 30 in a state in which the rotation speed of the anode 15 maintains the operation speed F2, the anode 15 will slowly decrease in the rotation speed by inertia without being braked (see FIG. 5, the reference numeral P4).

The deceleration by inertia takes for example, several tens of minutes. Therefore, in a case where the rotation speed of the anode is decreased by inertia from the operation speed F2 without activating the braking unit 30, the time Gh during which the rotation speed of the anode 15 is kept in the resonance range F3 becomes longer. Therefore, when the main power supply operation unit 33 is operated to be turned to the OFF state without activating the braking unit 30, the X-ray tube 5 is easily deteriorated because the time during which the X-ray tube 5 resonates becomes long.

Figure 6:
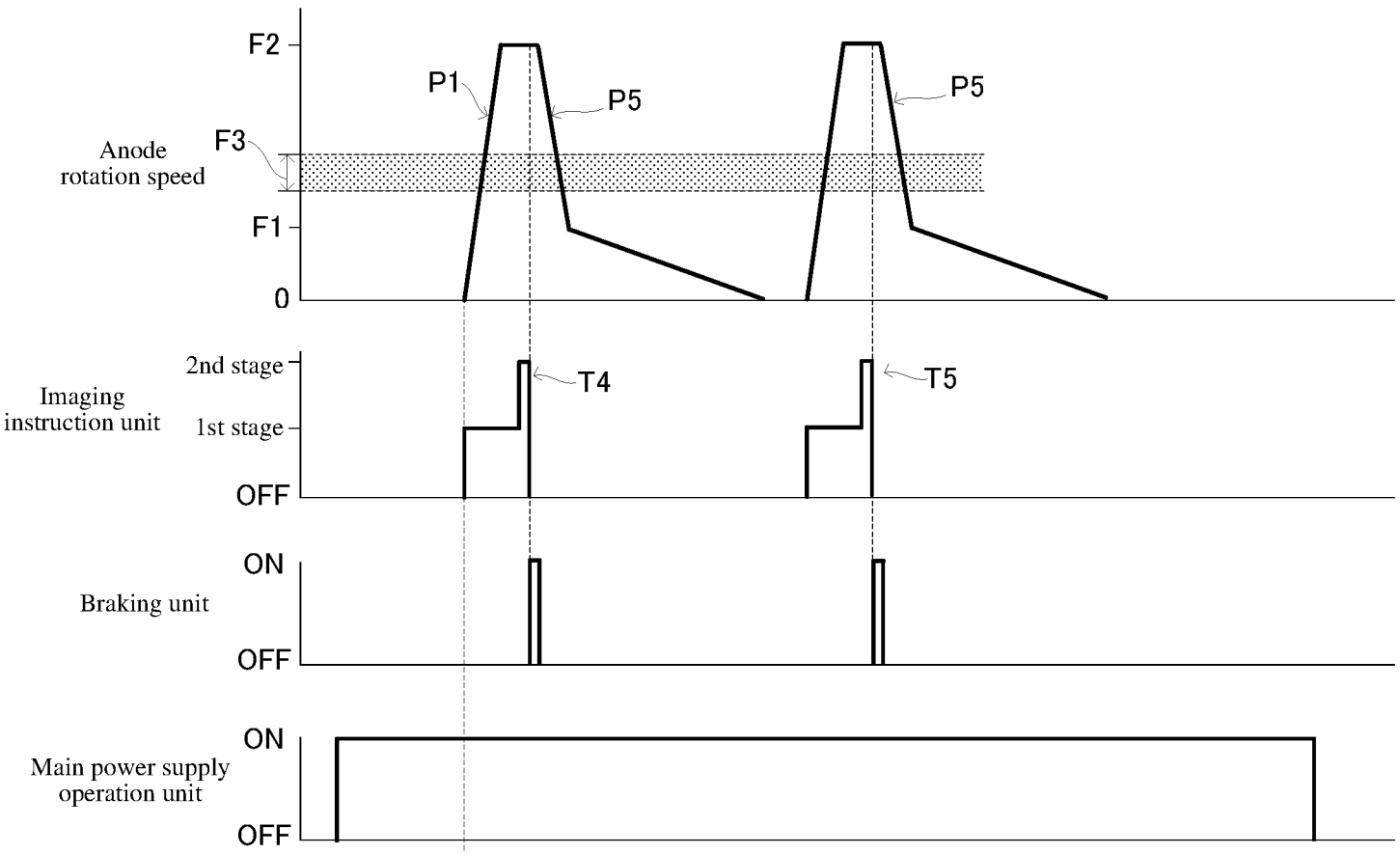
FIG. 6 is a timing chart for explaining the operation in a conventional X-ray imaging apparatus.

In a conventional system, after the rotation of the anode is accelerated to the operation speed F2, the rotation of the anode is braked every time the X-ray imaging is instructed. That is, as shown in FIG. 6, when the imaging instruction unit is operated at the time T4, the rotation speed of the anode is decreased immediately after the time T4 (see the reference numeral P5). Therefore, in the case of instructing the X-ray imaging again, it is required to operate the second stage operation of the imaging instruction unit after waiting that the anode is accelerated to the operation speed F2 again by performing the first stage operation of the imaging instruction unit (see symbol T5). For this reason, when X-ray imaging is performed successively with a conventional device, the time required for performing X-ray imaging becomes longer, which decreases the convenience of successive imaging.

In contrast, in the X-ray imaging apparatus 1 according to the example, in order to improve the convenience of successive imaging, it is configured such the rotation speed of the anode 15 is maintained at the operation speed F2 until the predetermined time DP has elapsed after the instruction of the X-ray imaging. In this case, the time during which the anode 15 is rotating at the operation speed F2 is relatively long. Therefore, a situation may occur in which in a state in which the rotation speed of the anode 15 is maintained at the operation speed F2, the operator S operates the main power supply operation unit 33 to be turned to the OFF state without performing the operation of the braking instruction unit 39.

Therefore, in order to avoid the impact by the resonance, the X-ray imaging apparatus 1 is configured such that a situation in which the X-ray tube 5 will resonate for a long time is predicted and the rotation speed of the anode 15 is quickly decreased by automatically activating the braking unit 30. Specifically, in this example, the X-ray imaging apparatus 1 is provided with an error detection unit 51, an examination end detection unit 53, and an operation time detection unit 57 so that for each of three different situations, it is configured to automatically avoid the resonance of the X-ray tube 5 by activating the braking unit 30. Hereinafter, the configuration for avoiding the resonance of the X-ray tube 5 in the X-ray imaging apparatus 1 will be described.

<Error Detection Unit>

First, the configuration for avoiding the resonance of the X-ray tube 5 by the error detection unit 51 will be described. As the situation in which it is predicted that the operator S operates the main power supply operation unit 33 to be turned to the OFF state, a case in which some error occurs in the X-ray imaging apparatus 1 and the X-ray imaging cannot be continued. In this event, since the operator S pays attention to the error notified by the notification unit 43, it may occur that the operator immediately operates the main power supply operation unit 33 to be turned to the OFF state without activating the braking unit 30.

In this example, such a situation is referred to as a "non-braking state" in which the power supply to the X-ray imaging apparatus 1 is stopped by turning the main power supply operation unit 33 to the OFF state without braking the anode 15 rotating at the operation speed F2 by the braking unit 30. That is, the fact that the error is notified in the X-ray imaging apparatus 1 denotes a situation in which it is predicted that the non-braking stop state is generated to cause the X-ray tube 5 to resonate for a long time.

Therefore, the error detection unit 51 has a function of notifying the notification unit 43 of the error and at the same time activating the braking unit 30. That is, for example, in a case where an error, such as, e.g., the collimator 13 interferes with an obstacle and the driving mechanism of the support member 8 is not activated, occurs in the X-ray imaging apparatus 1 at the time T6, the error detection unit 51 detects the occurrence of the error.

Figure 8:
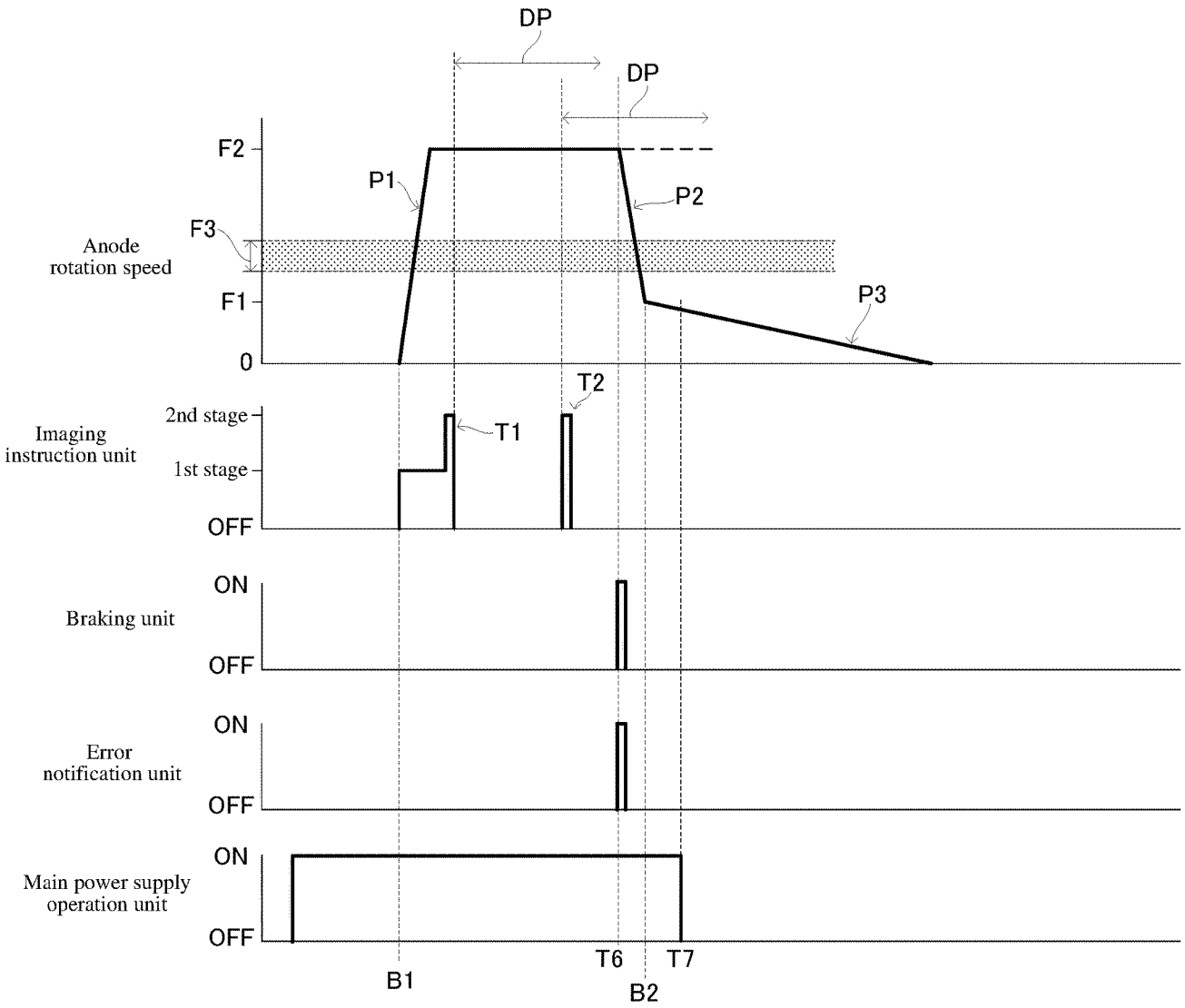
FIG. 8 is a timing chart showing the operation of the error detection unit in the X-ray imaging apparatus according to the example.

When the error detection unit 51 detects the error, the error detection unit 51 predicts the occurrence of the non-braking stop state, and a signal for activating the braking unit 30 is transmitted from the error detection unit 51 to the braking unit 30. With this signal, the braking unit 30 is activated to perform the control for decreasing the rotation of the anode 15 by the rotation drive unit 19. Consequently, as shown in FIG. 8, the anode 15 starts decelerating at the time T6, and the rotation speed of the anode 15 is rapidly decreased to the braking speed F1.

The error detection unit 51 transmits a signal to the braking unit 30 and transmits the information on the detected error to the notification unit 43. The notification unit 43 informs the operator S of the information on the transmitted error by letters, lights, sounds, or the like. That is, the operator S will grasp the error by the notification unit 43 after the activation of the braking unit 30 by the error detection unit 51.

Therefore, even in a case where the operator S immediately operates the main power supply operation unit 33 to be turned to the OFF state by recognizing the generation of the error, the rotation speed of the anode 15 has been already decreased from the operation speed F2 to the braking speed F1. Therefore, even in a case in which the braking unit 30 cannot be operated by the operation of turning the main power supply operation unit 33 to the OFF state, it is possible to avoid that the rotation speed of the anode 15 becomes the resonance range F3. As described above, in the X-ray imaging apparatus 1 according to this example, since the error detection unit 51 is provided, it is possible to avoid the situation in which the anode 15 is decelerated by inertia from the operation speed F2 and the X-ray tube 5 resonates for a long time due to the occurrence of the error.

<Description of Examination End Detection Unit>

Second, the configuration for avoiding the resonance of the X-ray tube 5 by the examination end detection unit 53 will be described. As a situation in which it is predicted that the operator S operates the main power supply operation unit 33 to be turned to the OFF state, there is a situation in which the examination instruction unit 35 is operated in Step S8 to input the instruction to end the examination.

Figure 7:
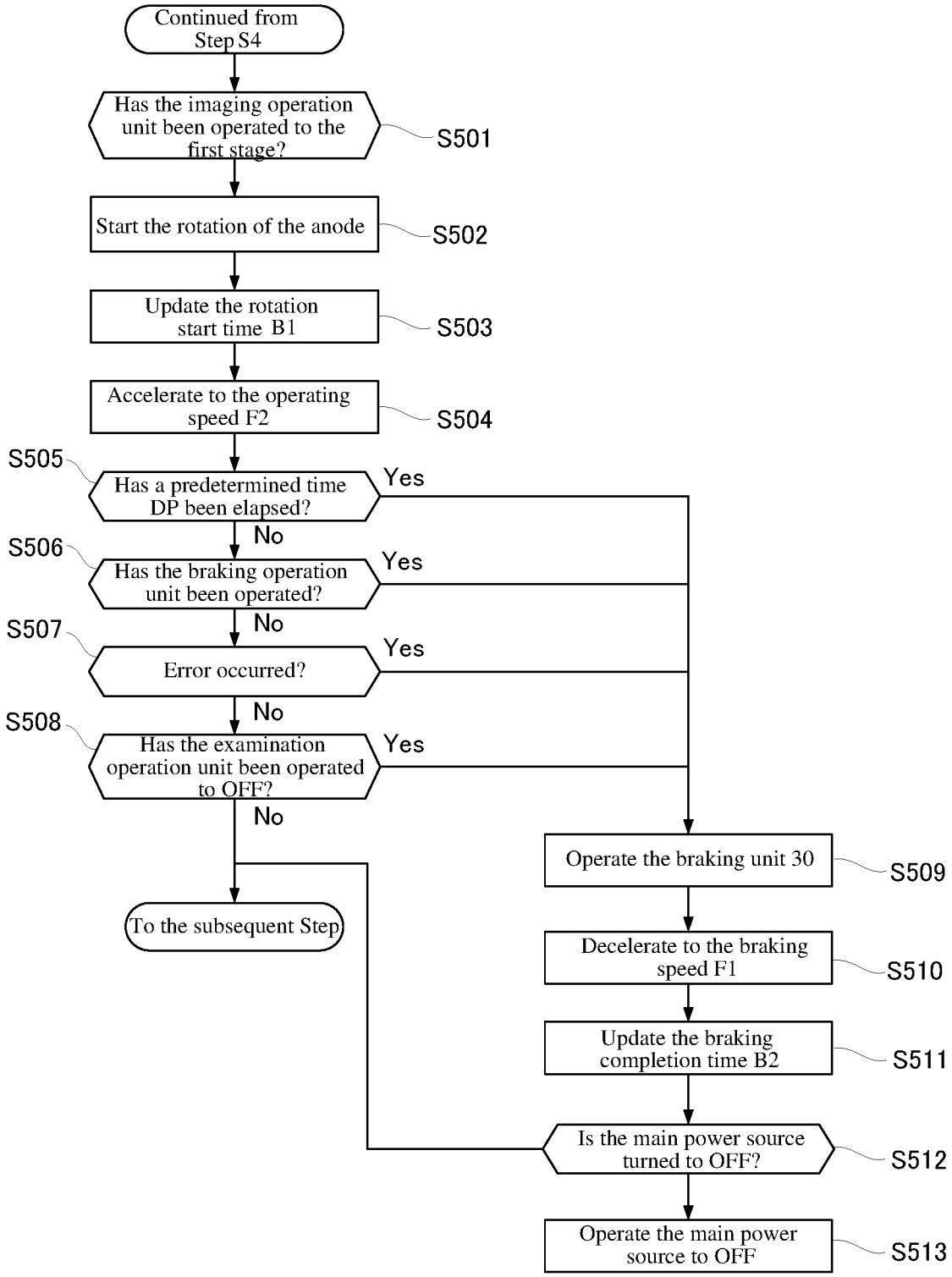
FIG. 7 is a flowchart for explaining the operation of an error detection unit and an examination end detection unit in the X-ray imaging apparatus according to the example.

After the anode 15 rotates at the operation speed F2, as shown in FIG. 7, in a case in which the predetermined time DP has elapsed (Step S505), when the braking instruction unit 39 is operated (Step S506), or in a case in which the error detection unit 51 detects the error (Step S507), the braking unit 30 is activated, and the rotation speed of the anode 15 is quickly decreased to the braking speed F1 (Steps S511 to S513).

However, when X-ray imaging is completed quickly and smoothly, there is a case in which the instruction of the examination end is input to the input device 11 without a predetermined time DP has elapsed and without the operation of the braking instruction unit 39 is performed, and the error occurs. In this case, the anode 15 is in a state of continuously rotating at the operation speed F2.

In this state, a situation may occur in which forgetting to operate the braking instruction unit 39, the operator S immediately operates the main power supply operation unit 33 to be turned to the OFF state without activating the braking unit 30 by operating the main power supply operation unit 33 to be turned to the OFF state. In other words, inputting the examination end instruction by the examination instruction unit 35 causes a situation in which it is predicted that the non-braking stop state occurs to cause the resonance of the X-ray tube 5 for a long time.

Therefore, the examination end detection unit 53 has the function of transmitting the information on the X-ray imaging to the server and operating the braking unit 30 at the same time by detecting the input of the instruction of the examination end. That is, when the operator S operates the examination instruction unit 35 at the time T8 and inputs an instruction of the examination end, the examination end detection unit 53 detects the instruction.

Figure 9:
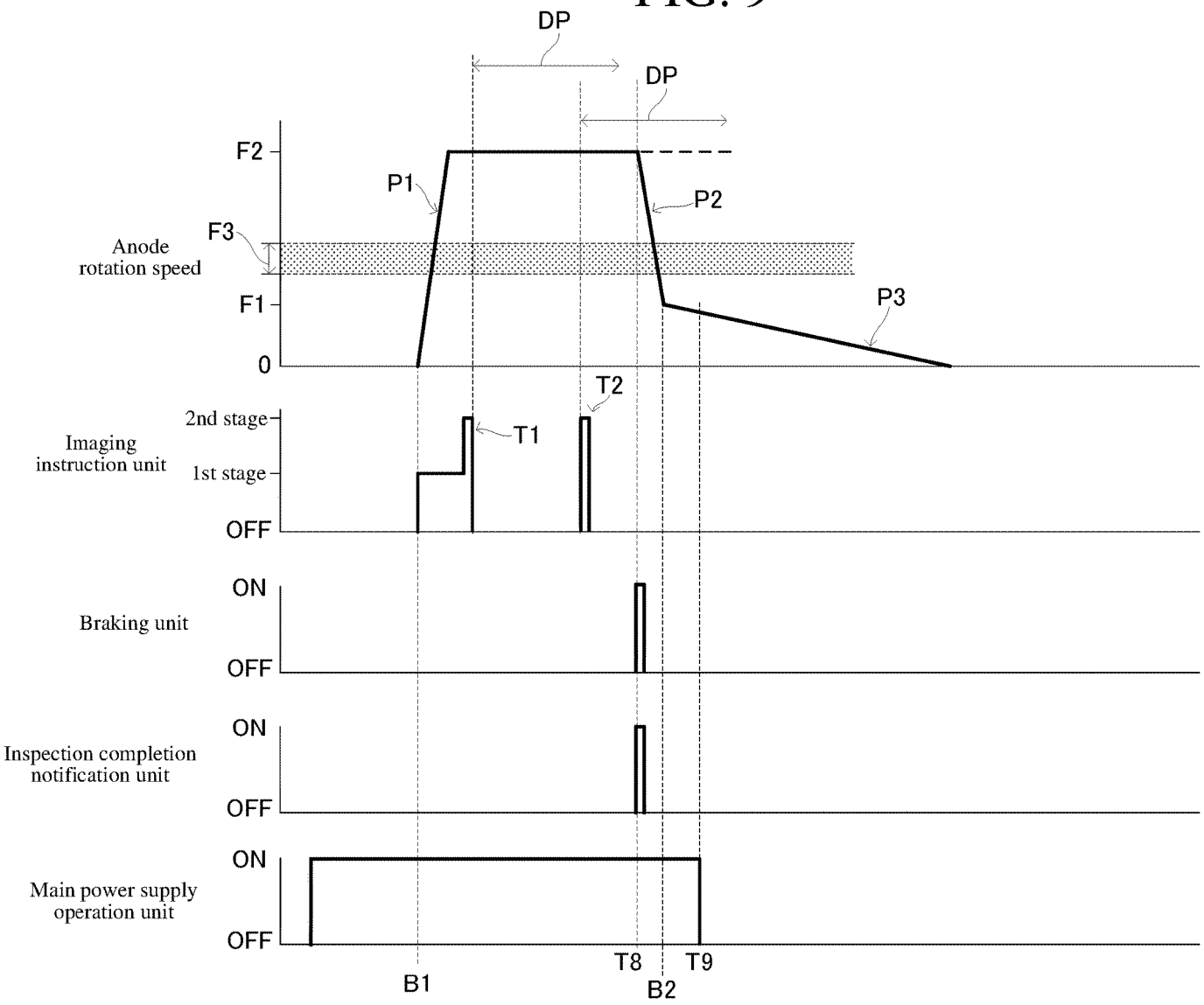
FIG. 9 is a timing chart showing the operation of the examination end detection unit in the X-ray imaging apparatus according to the example.

When the examination end detection unit 53 detects the instruction of the examination end, the examination end detection unit 53 predicts the occurrence of the non-braking stop state. Then, a signal for activating the braking unit 30 is transmitted from the examination end detection unit 53 to the braking unit 30. With this signal, the braking unit 30 is actuated to perform the control for decreasing the rotation speed of the anode 15 by the rotation drive unit 19. Consequently, as shown in FIG. 9, the anode 15 starts decelerating at the time T8, and the rotation speed of the anode 15 is rapidly decreased to the braking speed F1.

Therefore, even in a case where after inputting the examination end instruction, the operator S operates the main power supply operation unit 33 to be turned to the OFF state without operating the braking instruction unit 39, at the time T9, the rotation speed of the anode 15 has been already decreased from the operation speed F2 to the braking speed F1. Therefore, even in the case where the braking unit 30 cannot be activated because of the operation of turning the main power supply operation unit 33 to the OFF state, it is possible to avoid that the rotation speed of the anode 15 becomes in the resonance range F3. As described above, by providing the examination end detection unit 53 in the X-ray imaging apparatus 1 according to the example, it is possible to avoid the situation in which the anode 15 is decelerated from the operation speed F2 by inertia to cause the resonance of the X-ray tube 5 for a long time after the examination end instruction input in Step S8.

<Description of Operation Time Detection Unit>

Third, the configuration of avoiding the resonance of the X-ray tube 5 by the operation time detection unit 57 will be described. In the X-ray imaging apparatus 1, as a situation in which it is predicted that the main power supply operation unit 33 is an operation to be turned to the OFF state without activating the braking unit 30, a situation in which the inspection of the X-ray imaging apparatus 1 is performed without performing X-ray imaging. That is, the operation of the X-ray imaging apparatus 1 may be inspected at the time of starting or ending the work.

In the inspection, a situation may occur in which the inspection is completed by operating the main power supply operation unit 33 to be turned to the OFF state in a state in which the predetermined time DP (Step S505) has not been elapsed, the operation of the braking instruction unit 39 (Step S506) is not performed, and the error (Step S507) does not occur after the inspector rotates the anode 15 for confirming the operation of the X-ray tube 5. In the inspection, no instruction of the examination end is issued. Therefore, when the above-described situation occurs, the main power supply operation unit 33 is turned to the OFF state without activating the braking unit 30, and therefore the anode 15 starts gradually decelerating by inertia. Consequently, since the time Gh during which the rotation speed of the anode 15 is in the resonance range F3 becomes long, the X-ray tube 5 is likely to be deteriorated by the long-time resonant.

However, when the anode 15 rotating at the operation speed F2 slowly starts the deceleration by inertia, the time required for the rotation speed of the anode 15 to be decreased from the operation speed F2 to the resonance range F3 is relatively long, for example, several tens of minutes. That is, there is a time margin of several tens of minutes before the X-ray tube 5 starts the resonant after the inspector operates the main power supply operation unit 33 to be turned to the OFF state. Therefore, in a case where the main power supply operation unit 33 is operated to be turned to the ON state again after the rotation speed of the anode 15 is decreased to the resonance range F3 by inertia after the main power supply operation unit 33 is operated to be turned to the OFF state, the resonance of the X-ray tube 5 can be avoided by promptly activating the braking unit 30.

Therefore, the operation time detection unit 57 has a function of acquiring the rotation start time B1 and the braking completion time B2 to compare them to thereby predict the situation in which the main power supply operation unit 33 is operated to be turned to the OFF without activating the braking unit 30.

As shown in FIG. 7, when the anode 15 starts rotating so that the rotation speed becomes the operation speed F2 (Step S502), the start time is overwritten and stored as the most recent rotation start time B1 (Step S503). When the braking unit 30 is activated and the rotation speed of the anode 15 has been decreased to the braking speed F1, the time at which the rotation speed of the anode 15 has reached the braking speed F1 is overwritten as the most recent braking completion time B2 (Steps S509 to S511).

That is, as shown in FIG. 4 and FIG. 8, in a case in which the braking unit 30 is actuated ad the rotation speed of the anode 15 has been decreased to the braking speed F1 after the anode 15 has reached the operation speed F2, the rotation start time B1 is overwritten and stored in the storage unit 45 first, then the braking completion time B2 is overwritten and stored in the storage unit 45. That is, when the braking unit 30 is activated and the rotation speed of the anode 15 has been decreased from the operation speed F2 to the braking speed F1, the braking completion time B2 becomes a time later than the rotation start time B1.

On the other hand, in a case where the rotation speed of the anode 15 has been decreased by inertia without activating the braking unit 30 after the anode 15 has reached the operation speed F2, as shown in FIG. 5, the rotation start time B1 is overwritten and stored in the storage unit 45, but the braking completion time B2 is not overwritten and stored in the storage unit 45. Therefore, in a case in which the rotation speed of the anode 15 is decreased by inertia without activating the braking unit 30, the rotation start time B1 becomes a time later than the braking completion time B2.

As described above, by comparing the time of the most recent rotation start time B1 and the time of the most recent braking completion time B2, at the time at which the main power supply operation unit 33 is most recently operated to be turned to the OFF state, it is possible to know whether or not the deceleration of the anode 15 by the operation of the braking unit 30 has been performed.

Figure 10:
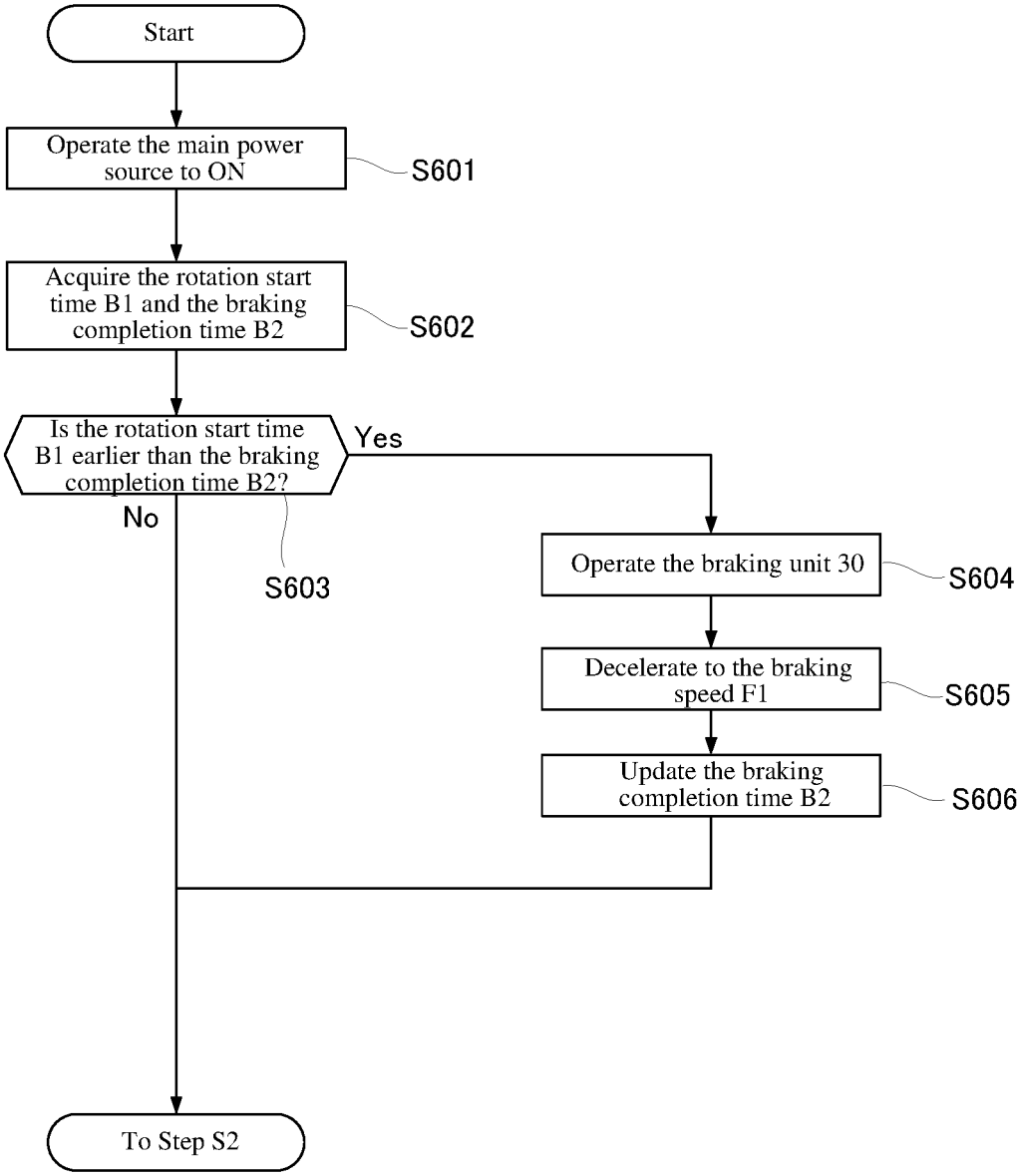
FIG. 10 is a flowchart for explaining the operation of the operation time detection unit in the X-ray imaging apparatus according to the example.

A series of operations for avoiding the resonance of the X-ray tube 5 using the operation time detection unit 57 will be described with reference to the flowchart of FIG. 10. First, the operation time detection unit 57 acquires the information on the rotation start time B1 and the information on the braking completion time B2 stored in the storage unit 45 (Steps S601, S602) with the operation of turning the main power supply operation unit 33 to the ON-state as a trigger. Then, depending on whether or not the rotation start time B1 is earlier than the braking completion time B2, the process is branched (Step S603).

Figure 11:
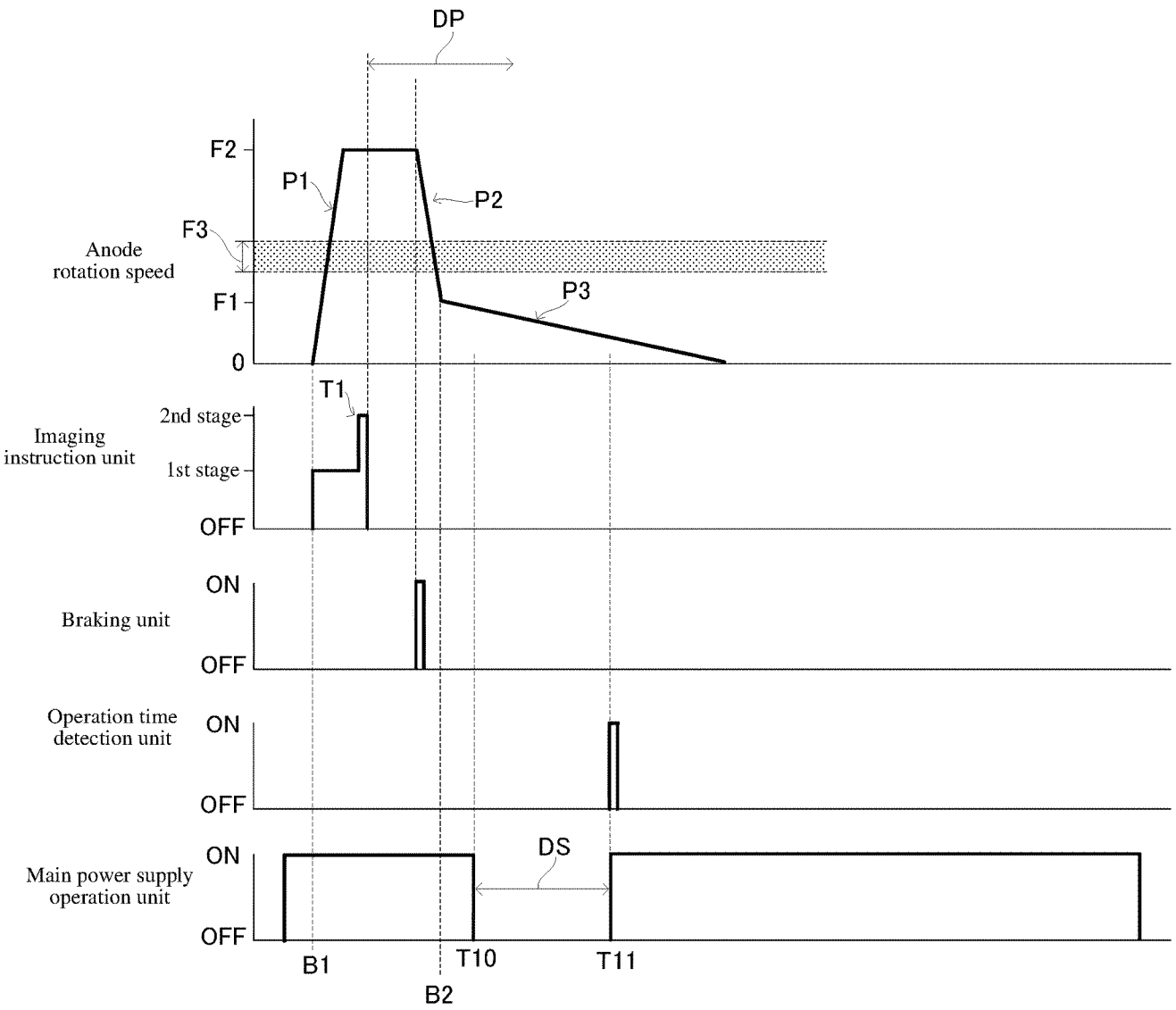
FIG. 11 is a timing chart showing a condition in which the operation time detection unit does not activate a braking unit in the X-ray imaging apparatus according to the example.

In a case in which the time of the rotation start time B1 is earlier than the time of the braking completion time B2, at the time T10 at which the main power supply operation unit 33 is most recently operated to be turned to the OFF state, it is possible that the braking unit 30 has been already activated and the anode 15 has been decelerated to the braking speed F1 (see FIG. 11). Therefore, in a state in which the main power supply operation unit 33 is turned to the ON state again at the time T11, there is no possibility that the X-ray tube 5 resonates. That is, there is no need to operate the braking unit 30 in a state in which the main power supply operation unit 33 has been turned to the ON state again. Therefore, the process proceeds to the subsequent Step without the operation time detection unit 57 activates the braking unit 30 at the time T11.

Figure 12:
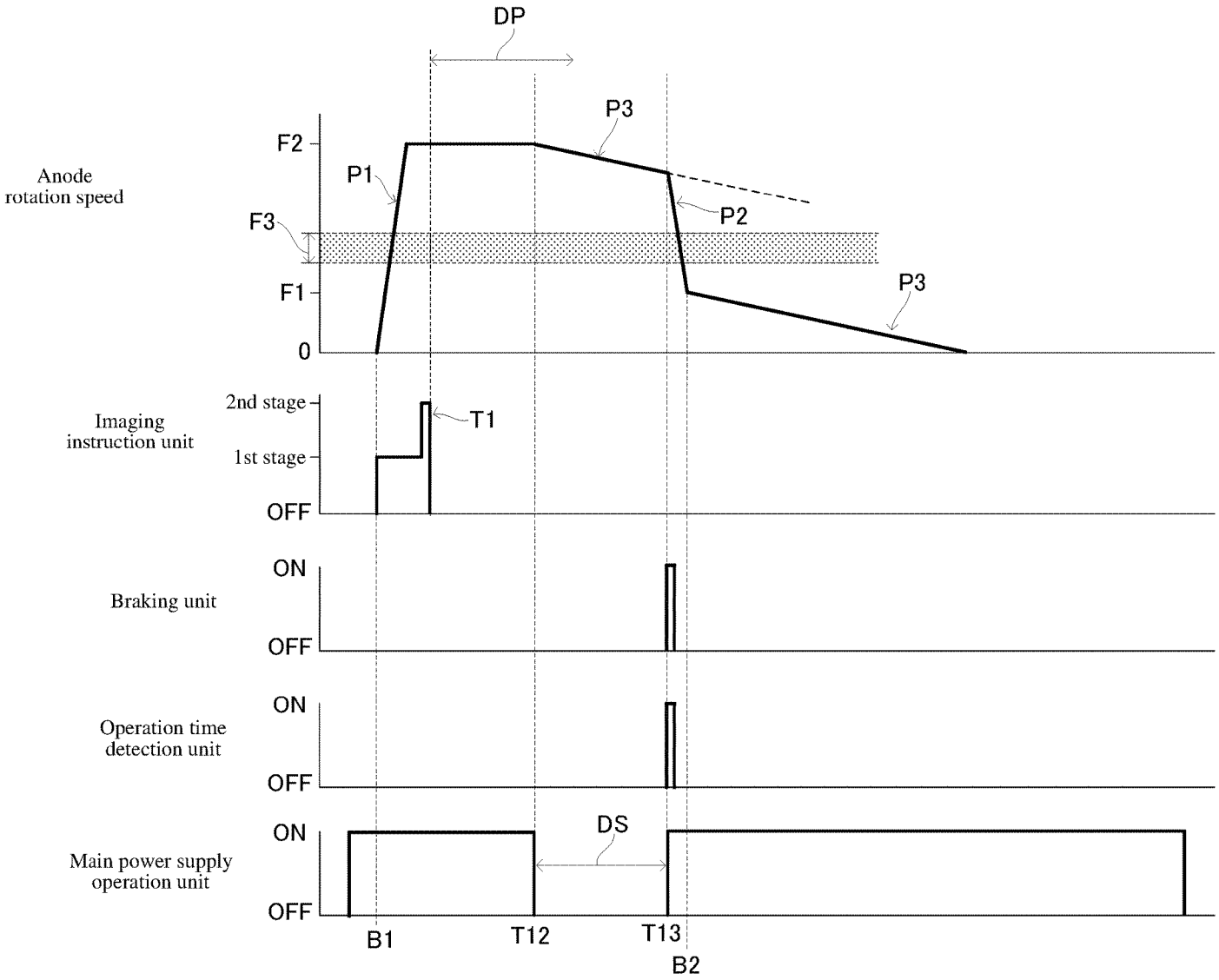
FIG. 12 is a timing chart showing a condition in which the operation time detection unit activates the braking unit in the X-ray imaging apparatus according to the example.

On the other hand, as shown in FIG. 12, in a case in which the time of the rotation start time B1 is later than the time of the braking completion time B2, when the X-ray imaging apparatus 1 is used most recently, it is possible to confirm that the main power supply operation unit 33 has been operated to be turned to the OFF state at the time T12 without activating the braking unit 30. Therefore, in a state in which the main power supply operation unit 33 is turned to the ON state again at the time T13, it is predicted that the anode 15 has been decelerated by inertia and the X-ray tube 5 is likely to resonate for a long time. In other words, the fact that the time of the rotation start time B1 is earlier than the time of the braking completion time B2 causes the situation in which the non-braking stop state occurs and the X-ray tube 5 will resonate for a long time.

Therefore, in a case where the time of the rotation start time B1 is later 3 ater than the time of the braking completion time B2, the operation time detection unit 57 predicts the occurrence of the non-braking stop state. Then, a signal for activating the braking unit 30 is transmitted from the operation time detection unit 57 to the braking unit 30 (see FIG. 12, the reference numeral T13). With this signal, the braking unit 30 is activated and the control for decelerating the rotation of the anode 15 by the rotation drive unit 19 is performed. Consequently, at the time T13, the anode 15 starts decelerating, and the rotation speed of the anode 15 is rapidly decreased to the braking speed F1 (Steps S604, S605). Then, the timer 55 detects the time at which the rotation speed of the anode 15 has been decreased to the braking speed F1 as the braking completion time B2, and the storage unit overwrites the braking completion time B2 and stores it to the storage unit 45 (Step S606).

As described above, by using the operation time detection unit 57, even in a case where the anode 15 has been decelerated by inertia at the time T12, the operation time detection unit 57 activates the braking unit 30 at the time T13. Since the rotation speed of the anode 15 is rapidly decreased to the braking speed F1 by the operation of the braking unit 30, it is possible to greatly shorten the time during which the rotation speed of anode 15 is in the resonance range F3. Therefore, it is possible to avoid the deterioration of the X-ray tube 5 by resonant.

<Effects by Configuration of Embodiments>

(Item 1)

The X-ray imaging apparatus according to this embodiment is an X-ray imaging apparatus provided with a cathode, an anode, a rotation drive unit for rotating the anode to a predetermined operation speed, and an X-ray tube for emitting X-rays from the anode toward a subject by applying a high voltage between the cathode and the anode, the anode being rotated at the predetermined operation speed. The X-ray imaging apparatus includes: a main power supply operation unit configured to switch ON/OFF of power supply to the X-ray imaging apparatus; a braking unit configured to decrease a rotation speed of the anode to a braking speed lower than a resonance speed that is a rotation speed of the anode at which resonance occurs in the X-ray tube; and a non-braking stop prediction unit configured to detect a predetermined situation in which a non-braking stop state is predicted, the non-braking stop state being a state in which the main power supply operation unit is operated to be turned to an OFF state without decelerating the rotating anode by the braking unit. The non-braking stop prediction unit activates the braking unit by detecting the predetermined situation to decrease the rotation speed of the anode to the braking speed.

According to the X-ray imaging apparatus recited in the above-described Item 1, the X-ray imaging apparatus is provided a non-braking stop prediction unit for detecting a predetermined situation in which the non-braking stop state is predicted. When it is detected the predetermined situation in which the non-braking stop state is predicted, the non-braking stop prediction unit activates the braking unit and decreases the rotation speed of the anode to the braking speed. The non-braking stop state is a state in which the main power supply operation unit is operated to be turned to the OFF state without decelerating the rotating anode by the braking unit.

The braking speed is a speed predetermined as a speed lower than the resonance range, and the resonance range is a rotation speed of the anode at which the resonance occurs in the X-ray tube. That is, the non-braking stop prediction unit decreases the rotation speed of the anode to the braking speed. Therefore, even when the non-braking stop state occurs, the rotation speed of the anode becomes the braking speed quickly, so that it is possible to avoid that the rotation speed of the anode becomes the resonance range for a long time. Therefore, even in a case where the anode is configured to continuously rotate at a constant time operation speed, it is possible to prevent from becoming the non-braking stop state. As a result, it is possible to perform the generation of successive X-rays in a short time, and it is also possible to more assuredly prevent the deterioration of the X-ray tube due to the resonance.

(Item 2)

Further, in the X-ray imaging apparatus as recited in the above-described Item 1, the non-braking stop prediction unit is provided with an error detection unit for detecting an error generated in the X-ray imaging apparatus. The error detection unit activates the braking unit by detecting an occurrence of the error to decrease the rotation speed of the anode to the braking speed.

According to the X-ray imaging apparatus as recited in the above-described Item 3, in a case where an error occurs in the X-ray imaging apparatus 1, a situation is predicted in which the operator operates the main power supply operation unit to be turned to the OFF state without activating the braking unit. Therefore, when the error detection unit detects an error, the error detection unit controls the drive unit so that the rotation speed of the anode is automatically decreased to the braking speed. By providing the error detection unit, it is possible to prevent that the non-braking stop state occurs and the X-ray tube becomes easily and quickly deteriorated.

(Item 3)

In the X-ray imaging apparatus as recited in the above-described Item 1 or 2, the X-ray imaging apparatus further includes an examination end instruction unit configured to input an end instruction of an examination of a subject. The non-braking stop prediction unit includes an examination end detection unit for detecting the input by the examination end instruction unit. The examination end detection unit activates the braking unit by detecting the input by the examination end instruction unit and decreases the rotation speed of the anode to the braking speed.

According to the X-ray imaging apparatus as recited in the above-described Item 3, a situation is predicted in which the operator operates the main power supply operation unit is operated to be turned to the OFF state without activating the braking unit when an instruction to end the examination of the object is input. Therefore, by configuring such that when the examination end detection unit detects the examination end instruction, the drive unit automatically decreases the rotation speed of the anode to the braking speed, it is possible to prevent that the X-ray tube becomes easily deteriorated due to the occurrence of the non-braking stop state.

(Item 4)

Further, in the X-ray imaging apparatus as recited in any one of the above-described Items 1 to 3, the X-ray imaging apparatus further includes a timer configured to detect a rotation start time and a braking completion time, the rotation start time being a time at which the anode starts rotating by the rotation drive unit, and the braking completion time being a time at which the rotation speed of the anode is decreased to the braking speed by the braking unit, and a storage unit configured to overwrite and store the rotation start time and the braking completion time detected by the timer. The non-braking stop prediction unit is provided with an operation time detection unit configured to determine which of the rotation start time and the braking completion time is earlier when the main power supply operation unit is operated to be turned to an ON state. The operation time detection unit activates the braking unit when it is determined that the rotation start time is earlier than the braking completion time to decrease the rotation speed of the anode to the braking speed. The operation time detection unit activates the braking unit when it is determined that the rotation start time is earlier than the braking completion time to decrease the rotation speed of the anode to the braking speed.

According to the X-ray imaging apparatus as recited in the above-described Item 4, the rotation start time is detected by the timer as the time at which the anode starts rotating and is overwritten and stored in the storage unit. The braking completion time is detected by the timer as the time at which the rotation speed of the anode was decreased to the braking speed and is overwritten and stored in the storage unit. Therefore, in a case in which the rotation start time is earlier than the braking completion time, since the braking unit is not activated after the anode starts rotating, the occurrence of the non-braking stop state is predicted. Therefore, in a case where the operation time detection unit determines that the rotation start time is earlier than the braking completion time, the drive unit automatically decreases the rotation speed of the anode to the braking speed. Therefore, it is possible to prevent that the non-braking stop state occurs and the X-ray tube 5 becomes to be easily deteriorated.

(Item 5)

Further, in the X-ray imaging apparatus as recited in any one of the above-described Items 1 to 4, the X-ray imaging apparatus further includes a stop time measurement means configured to measure a stop time, the stop time being a time from a time at which the main power supply operation unit is operated to be turned to an OFF state to a stop time at which the main power supply operation unit is next operated to be turned to an ON state. The non-braking stop prediction unit is provided with a stop time determination unit configured to determine which of a resonance speed reach time and the stop time is longer when the main power supply operation unit is operated to be turned to the ON state, the resonance speed reach time being a time required to decrease the rotation speed of the anode from the operation speed to the resonance speed without activating the braking unit by inertia. The stop time determination unit activates the braking unit when it is determined that the resonance speed reach time is longer than the stop time to decrease the rotation speed of the anode to the braking speed.

According to the X-ray imaging apparatus as recited in the above-described Item 5, when the main power supply operation unit is operated to be turned to the ON state, it is provided with a stop time determination unit for determining which of the resonance speed reach time and the stop time is longer. The stop time determination unit activates the drive when it is determined that the resonance speed reach time is longer than the stop time and decreases the rotation speed of the anode to the braking speed.

The resonance speed reach time is determined in advance as the time required for the rotation speed of the anode to reach from the operation speed to the resonance speed by inertia without activating the braking unit. For this reason, in a case in which the resonance speed reach time is longer than the stop time, it is predicted that the non-braking stop state will occur. Therefore, in a case in which the stop time determination unit determines that the resonance speed reach time is longer than the stop time, the driving unit automatically decreases the rotation speed of the anode to the braking speed. Thus, it is possible to prevent that the non-braking stop state occurs and the X-ray tube easily becomes deteriorated.

OTHER EMBODIMENTS

It should be understood that the examples disclosed herein are illustrative in all aspects and are not restrictive. The scope of the present invention includes all changes within claims and the meanings and the range equivalent to the claims. For example, the present invention may be modified as follows.

(1) In the above-described example, the non-braking stop prediction unit 50 is provided with the error detection unit 51, the examination end detection unit 53, and the operation time detection unit 57, but the non-braking stop prediction unit 50 is not limited to the configuration provided with these three units. That is, it may be configured such that the non-braking stop prediction unit 50 may be provided with at least one of the error detection unit 51, the examination end detection unit 53, and the operation time detection unit 57.

Figure 13:
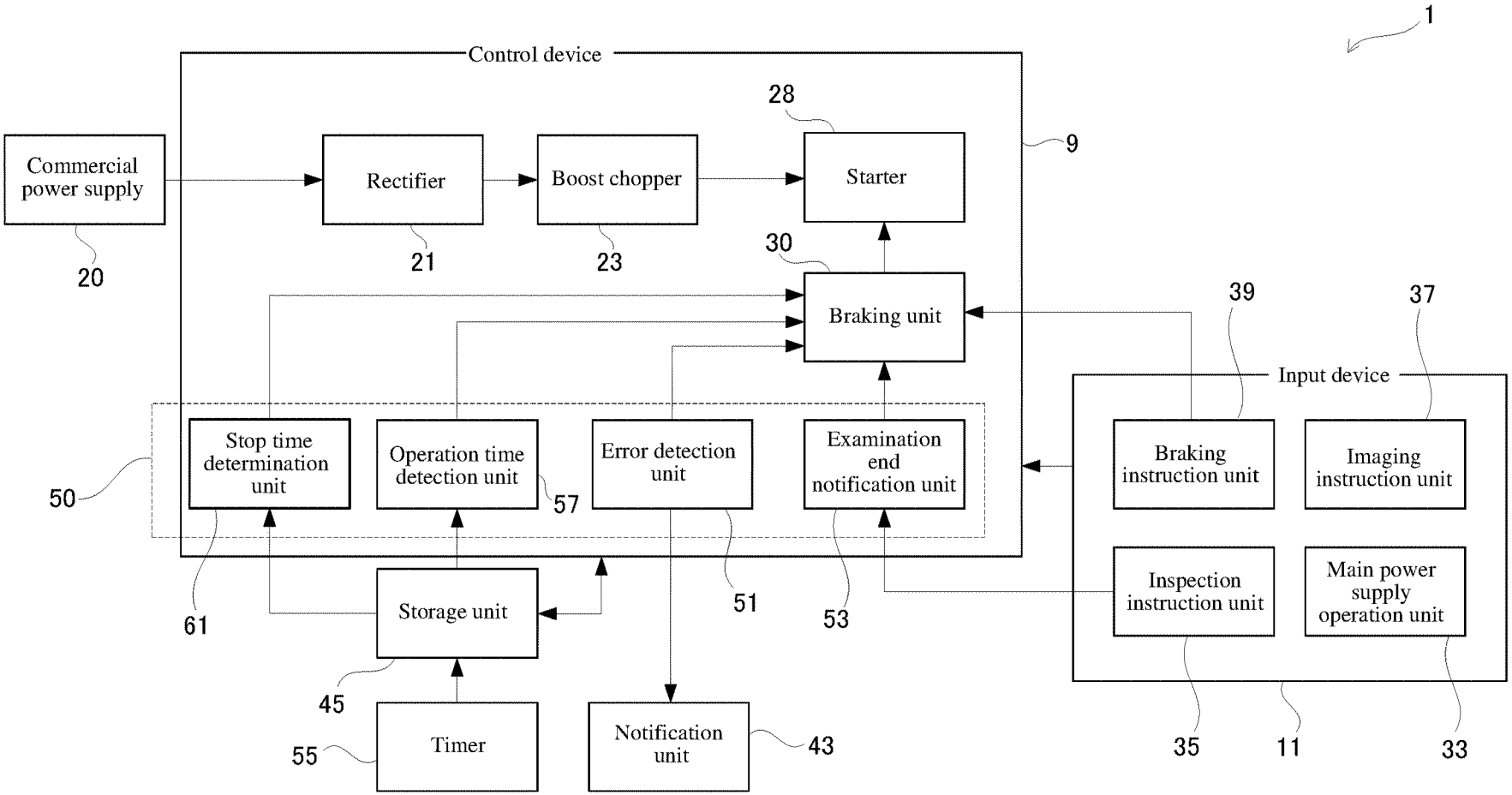
FIG. 13 is a functional block diagram for explaining the main configuration of the X-ray imaging apparatus according to a modification.

(2) In the above-described example, as shown in FIG. 13, the non-braking stop prediction unit 50 may be further provided with the stop time determination unit 61. For the convenience of explanation, in FIG. 13, it is limited to show the main configuration. The configurations of the X-ray tube 5, the inverter 25, and the image generation unit 31 are omitted. Further, the non-braking stop prediction unit 50 may omit each of the error detection unit 51, the examination end detection unit 53, and the operation time detection unit 57 and may be provided with only the stop time determination unit 61 as a configuration for preventing the resonance of the X-ray tube 5 by predicting the non-braking stop state.

The stop time determination unit 61 detects the situation in which the non-braking stop state is predicted by determining which of the resonance speed reach time DS and the stop time SP is longer when the main power supply operation unit 33 is turned to be the ON state.

Note that the resonance speed reach time DS means, as shown in FIG. 5, the time required for the rotation speed of the anode 15 to reach the resonance range F3 from the operation speed F2 without activating the braking unit 30 to the anode 15 rotating at the operation speed F. Further, the stop time SP means, as shown in FIG. 11 or FIG. 12, the time from the time at which the main power supply operation unit 33 is operated to be turned to the OFF state to the time at which the main power supply operation unit 33 is operated to be turned to the ON state next. More specifically, the time from the time T10 to the time T11 in FIG. 11 or the time from the time T12 to the time T13 in FIG. 12 corresponds to the stop time SP.

In this modification, the resonance speed reach time DS and the stop time SP are measured using the timer 55. In this instance, the timer 55 corresponds to the stop time measuring unit in the present invention. However, the configuration for measuring the resonance speed reach time DS and the stop time SP is not limited to the timer 55. Further, the time required to reach the resonance speed reach time DS and the stop time SP may be measured using different measuring means, respectively. The length of the resonance speed reach time DS and the stop time SP may be measured in advance and stored in the storage unit 45.

Figure 15:
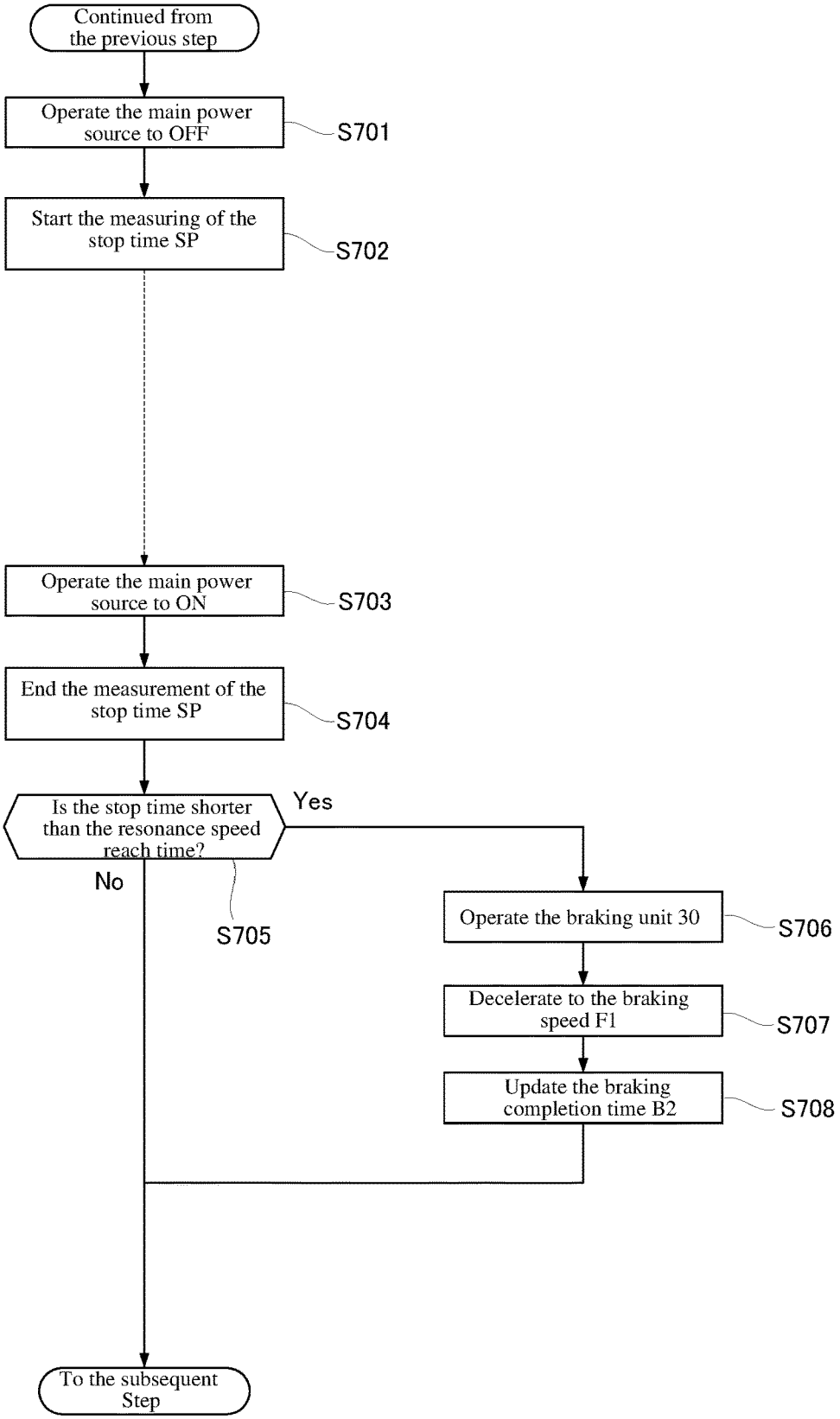
FIG. 15 is a flowchart for explaining the operation of the stop time determination unit in the X-ray imaging apparatus according to the modification.

In the configuration provided with the stop time determination unit 61, the series of operations for avoiding the resonance of the X-ray tube 5 by detecting the situation in which the non-braking stop state is predicted will be described with reference to the flowchart of FIG. 15. First, the timer 55 starts measuring the stop time SP (Step S701, S702), triggering that the main power supply operation unit 33 is operated to be turned to the OFF state.

Then, the timer 55 completes the measurement of the stop time SP, triggering that the main power supply operation unit 33 is next operated to be turned to the ON state (Steps S703, S704). The information on the measured stop time SP is transmitted from the timer 55 to the stop time determination unit 61. In synchronization with the transmission of the stop time SP, the information on the resonance speed reach time DS is transmitted from the storage unit 45 to the stop time determination unit 61.

The stop time determination unit 61 determines which of the resonance speed reach time DS or the stop time SP is longer. Subsequently, the process is branched depending on whether or not the stop time SP is longer than the resonance speed reach time DS (Step S705).

Figure 14:
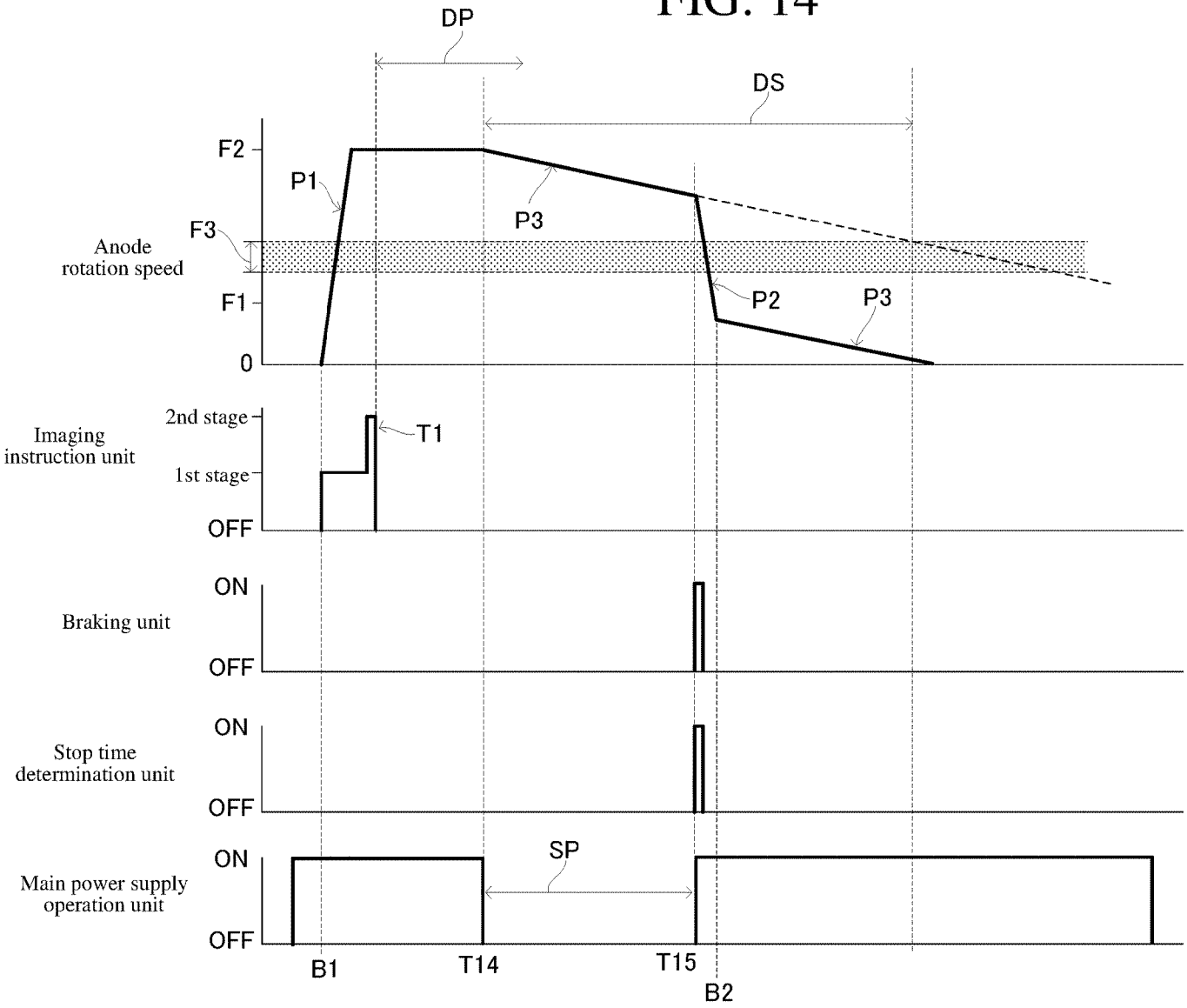
FIG. 14 is a timing chart for explaining the condition in which the stop time determination unit activates the braking unit in the X-ray imaging apparatus according to a modification.

As shown in FIG. 14, in a case in which the stop time SP is shorter than the resonance speed reach time DS, the braking unit 30 is activated to quickly decrease the rotation speed of the anode 15 to the braking speed F1. That is, at a time T14 at which the main power supply operation unit 33 is most recently operated to the OFF state, in a case where the anode 15 starts decelerating by inertia without activating the braking unit 30, the rotation speed of the anode 15 at the time T15 at which the main power supply operation unit 33 was turned ON again is still maintained at the speed faster than the speed in the resonance range F3.

That is, it is predicted that the X-ray tube 5 has not become in the resonance state at the time T15 and the X-ray tube 5 will resonate for a long time if the anode 15 is kept rotated by inertia 5. In other words, the fact that the stop time SP is shorter than the resonance speed reach time DS causes the situation in which it is predicted that the non-braking stop state will generate and the X-ray tube 5 will resonate for a long time.

Therefore, in a case in which the stop time SP is shorter than the resonance speed reach time DS, the stop time determination unit 61 predicts the occurrence of the non-braking stop state. At the time T15 shown in FIG. 14, the signal for activating the braking unit 30 is transmitted from the stop time determination unit 61 to the braking unit 30. With this signal, the braking unit 30 is activated and the control for decelerating the rotation of the anode 15 by the rotation drive unit 19 is performed. Consequently, at the time T15, the anode 15 starts decelerating, and the rotation speed of the anode 15 is rapidly decreased to the braking speed F1 (Steps S706, S707). Then, the timer 55 detects the time at which the rotation speed has been decreased to the braking speed F1 as the braking completion time B2, and the storage unit 45 overwrites and stores the braking completion time B2 (Step S708).

Figure 16:
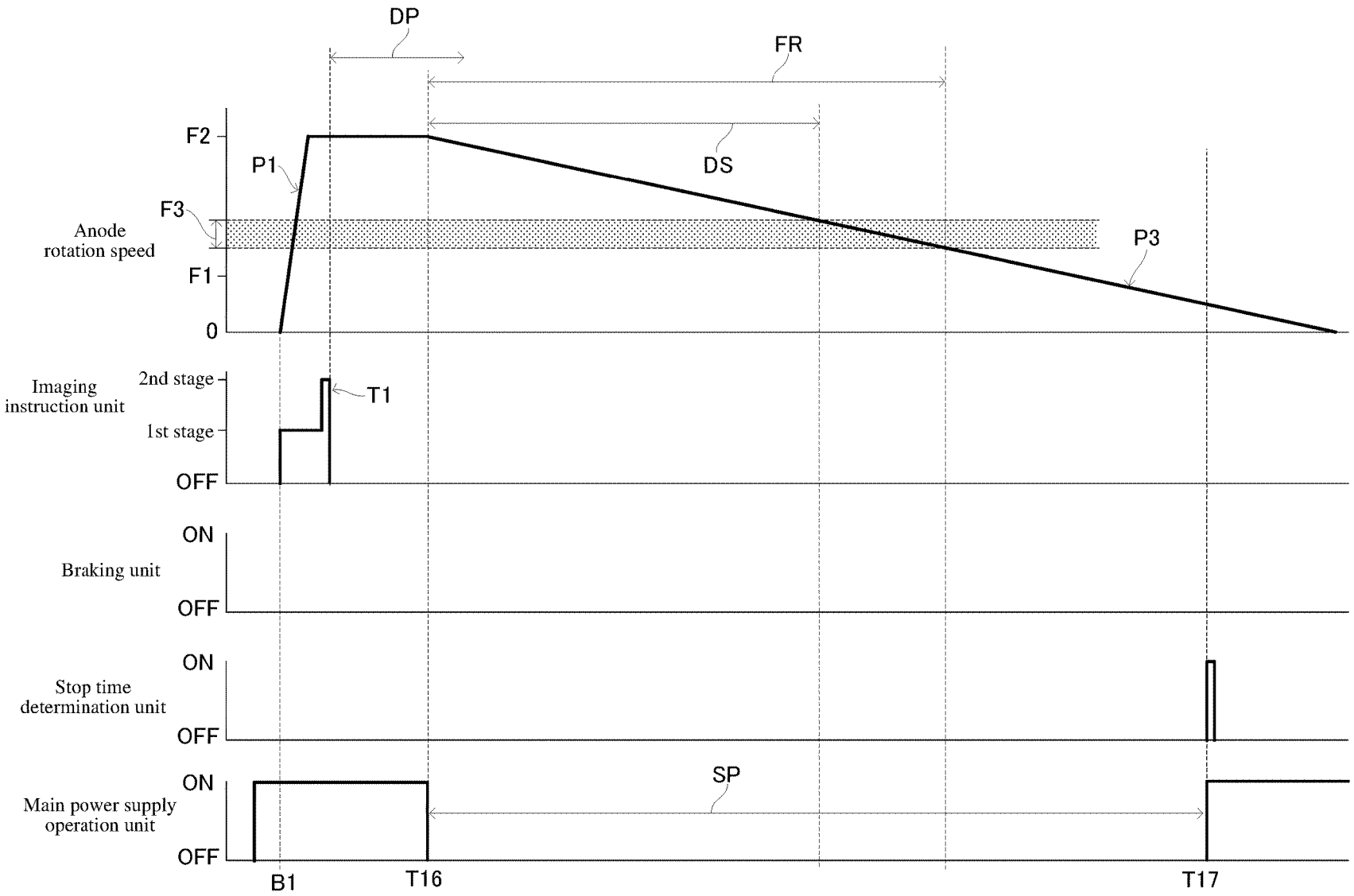
FIG. 16 is a timing chart for explaining the state in which the stop time determination unit does not activate the braking unit in the X-ray imaging apparatus according to the modification.

On the other hand, as shown in FIG. 16, in a case in which the stop time SP is longer than the resonance speed reach time DS, the process proceeds to the subsequent Step without activating the braking unit 30. That is, at the time T16 at which the main power supply operation unit 33 is most recently operated to be turned to the OFF state, even when the anode 15 starts decelerating by inertia without activating the braking unit 30, the rotation speed of the anode 15 at the time T17 at which the main power supply operation unit 33 was turned to the ON state again is decreased to a speed lower than the resonance range F3. Therefore, there is no need to operate the braking unit 30 at the time T17 at which the main power supply operation unit 33 is turned to the ON state again. Therefore, at the Time T17, the stop time determination unit 61 proceeds to the subsequent Step without activating the braking unit 30.

By using the stop time determination unit 61 as described above, it is possible to avoid that the X-ray tube 5 is deteriorated by resonant. That is, even in a case where the braking unit 30 has not been activated and the anode 15 has started decelerating by inertia at the time T14, the stop time determination unit 61 activates the braking unit 30 at the time T15. By the operation of the braking unit 30, the rotation speed of the anode 15 is rapidly decreased to the braking speed F1. Therefore, it is possible to greatly shorten the time at which the rotation speed of the anode 15 reaches the resonance range F3. Therefore, it is possible to assuredly avoid the deterioration of the X-ray tube 5 due to the long-time resonance.

(3) In the example described above, an example is shown in which the X-ray imaging apparatus 1 is provided with the top board 3 and X-ray imaging is performed on the subject M in the decubitus position, but the configuration is not limited to the configuration having the top board 3. That is, the X-ray imaging apparatus 1 may be configured such that X-ray imaging is performed on the subject M in a standing position.

(4) In the example described above, the X-ray tube 5 is not limited to the configuration supported by the support member 8 suspended from the ceiling. For example, the support member 8 supporting the X-ray tube 5 may be connected to the top board 3, or the support member 8 may be disposed on a floor surface or a wall surface of the imaging room R1.

(5) In the example described above, as the resonance speed reach time DS which is a time required to decrease the rotation speed of the anode 15 by inertia from the operation speed F2 to the resonance range F3, as shown in FIG. 5, the time required for the rotation speed of the anode 15 to reach from the operation speed F2 to the maximum value of the resonance range F3 is adopted, but not limited thereto. For example, as shown in FIG. 16, the time FR required for the rotation speed of the anode 15 to reach the minimum value of the resonance range F3 from the operation speed F2 may be adopted. Further, the time required for the rotation speed of the anode 15 to reach any of the values included from the operation speed F2 to the resonance range F3 may be adopted as the resonance speed reach time DS.

(6) In the example described above, the operation time detection unit 57 is configured to compare the rotation start time B1 and the braking completion time B2 at the time at which the main power supply operation unit 33 is operated to be turned to the ON state and activates the braking unit 30 in a case where the rotation start time B1 is later than the braking completion time B2, but not limited thereto. For example, the operation time detection unit 57 may be configured to unconditionally activate the braking unit 30 at the time at which the main power supply operation unit 33 is operated to be turned to the ON state.

In such modifications, in a case in which a non-braking condition occurs and the anode 15 starts decelerating by inertial and approaches the resonance range F3, the braking unit 30 is activated unconditionally at the time at which the main power supply operation unit 33 is operated to be turned to the ON state. Therefore, it is possible to avoid that the rotation speed of the anode 15 becomes in the resonance range F3 for a long time. Also, by configuring such that the operation time detection unit 57 activates the braking unit 30 unconditionally, it is possible to omit the configuration for detecting or storing the rotation start time B1 and the braking completion time B2. It is also possible to omit the calculation of comparing and determining the rotation start time B1 and the braking completion time B2. Therefore, the configuration of the X-ray imaging apparatus 1 can be further simplified.

DESCRIPTION OF SYMBOLS

1: X-ray imaging apparatus
3: Top board
5: X-ray tube
7: X-ray detector
9: Control device
11: Input device
13: Collimator
15: Anode
17: Cathode
19: Rotation drive unit
25: Inverter
27: High-voltage generation unit
28: Starter
30: Braking unit
30: Image generation unit
33: Main power supply operation unit
35: Examination instruction unit
37: Imaging instruction unit
39: Braking instruction unit
43: Notification unit
45: Storage unit
51: Error detection unit
53: Examination end detection unit
55: Timer
57: Operation time detection unit
61: Stop time determination unit

The invention claimed is:

1. An X-ray imaging apparatus provided with a cathode, an anode, a rotation drive unit for rotating the anode to a predetermined operation speed, and an X-ray tube for emitting X-rays from the anode toward a subject by applying a high voltage between the cathode and the anode, the anode being rotated at the predetermined operation speed, the X-ray imaging apparatus comprising:

a main power supply operation unit configured to switch ON/OFF of power supply to the X-ray imaging apparatus;

a braking unit configured to decrease a rotation speed of the anode to a braking speed lower than a resonance speed that is a rotation speed of the anode at which resonance occurs in the X-ray tube; and a non-braking stop prediction unit configured to detect a predetermined situation in which a non-braking stop state is predicted to occur in the future, the non-braking stop state being a state in which the main power supply operation unit is operated to be turned to an OFF state without decelerating the anode that is rotating at a speed faster than the resonance speed by the braking unit, wherein the non-braking stop prediction unit activates the braking unit by detecting the predetermined situation to decrease the rotation speed of the anode to the braking speed before the non-braking stop state occurs.

2. The X-ray imaging apparatus as recited in claim 1, wherein the non-braking stop prediction unit is provided with an error detection unit for detecting an error generated in the X-ray imaging apparatus, and wherein the error detection unit activates the braking unit by detecting an occurrence of the error to decrease the rotation speed of the anode to the braking speed.

3. The X-ray imaging apparatus as recited in claim 1, further comprising:

an examination end instruction unit configured to input an end instruction of an examination of a subject, wherein the non-braking stop prediction unit includes an examination end detection unit for detecting the input by the examination end instruction unit, and wherein the examination end detection unit activates the braking unit by detecting the input by the examination end instruction unit and decreases the rotation speed of the anode to the braking speed.

4. The X-ray imaging apparatus as recited in claim 1, further comprising:

a timer configured to detect a rotation start time and a braking completion time, the rotation start time being a time at which the anode starts rotating by the rotation drive unit, and the braking completion time being a time at which the rotation speed of the anode is decreased to the braking speed by the braking unit; and a storage unit configured to overwrite and store the rotation start time and the braking completion time detected by the timer, wherein the non-braking stop prediction unit is provided with an operation time detection unit configured to determine which of the rotation start time and the braking completion time is earlier when the main power supply operation unit is operated to be turned to an ON state, and wherein the operation time detection unit activates the braking unit when it is determined that the rotation start time is later than the braking completion time to decrease the rotation speed of the anode to the braking speed.

5. The X-ray imaging apparatus as recited in claim 1, further comprising:

a stop time measurement means configured to measure a stop time, the stop time being a time from a time at which the main power supply operation unit is operated to be turned to an OFF state to a stop time at which the main power supply operation unit is next operated to be turned to an ON state, wherein the non-braking stop prediction unit is provided with a stop time determination unit configured to determine which of a resonance speed reach time and the stop time is longer when the main power supply operation unit is operated to be turned to the ON state, the resonance speed reach time being a time required to decrease the rotation speed of the anode from the operation speed to the resonance speed without activating the braking unit by inertia, and wherein the stop time determination unit activates the braking unit when it is determined that the resonance speed reach time is longer than the stop time to decrease the rotation speed of the anode to the braking speed.

6. An X-ray imaging apparatus provided with a cathode, an anode, a rotation drive unit for rotating the anode to a predetermined operation speed, and an X-ray tube for emitting X-rays from the anode toward a subject by applying a high voltage between the cathode and the anode, the anode being rotated at the predetermined operation speed, the X-ray imaging apparatus comprising:

a main power supply operation unit configured to switch ON/OFF of power supply to the X-ray imaging apparatus;

a braking unit configured to decrease a rotation speed of the anode to a braking speed lower than a resonance speed that is a rotation speed of the anode at which resonance occurs in the X-ray tube;

a non-braking stop prediction unit configured to detect a predetermined situation in which a non-braking stop state is predicted, the non-braking stop state being a state in which the main power supply operation unit is operated to be turned to an OFF state without decelerating the rotating anode by the braking unit;

a timer configured to detect a rotation start time and a braking completion time, the rotation start time being a time at which the anode starts rotating by the rotation drive unit, and the braking completion time being a time at which the rotation speed of the anode is decreased to the braking speed by the braking unit; and a storage unit configured to overwrite and store the rotation start time and the braking completion time detected by the timer, wherein the non-braking stop prediction unit activates the braking unit by detecting the predetermined situation to decrease the rotation speed of the anode to the braking speed, wherein the non-braking stop prediction unit is provided with an operation time detection unit configured to determine which of the rotation start time and the braking completion time is earlier when the main power supply operation unit is operated to be turned to an ON state, and wherein the operation time detection unit activates the braking unit when it is determined that the rotation start time is later than the braking completion time to decrease the rotation speed of the anode to the braking speed.

7. An X-ray imaging apparatus provided with a cathode, an anode, a rotation drive unit for rotating the anode to a predetermined operation speed, and an X-ray tube for emitting X-rays from the anode toward a subject by applying a high voltage between the cathode and the anode, the anode being rotated at the predetermined operation speed, the X-ray imaging apparatus comprising:

a main power supply operation unit configured to switch ON/OFF of power supply to the X-ray imaging apparatus;

a braking unit configured to decrease a rotation speed of the anode to a braking speed lower than a resonance speed that is a rotation speed of the anode at which resonance occurs in the X-ray tube;

a non-braking stop prediction unit configured to detect a predetermined situation in which a non-braking stop state is predicted, the non-braking stop state being a state in which the main power supply operation unit is operated to be turned to an OFF state without decelerating the rotating anode by the braking unit; and a stop time measurement means configured to measure a stop time, the stop time being a time from a time at which the main power supply operation unit is operated to be turned to an OFF state to a stop time at which the main power supply operation unit is next operated to be turned to an ON state, wherein the non-braking stop prediction unit activates the braking unit by detecting the predetermined situation to decrease the rotation speed of the anode to the braking speed, wherein the non-braking stop prediction unit is provided with a stop time determination unit configured to determine which of a resonance speed reach time and the stop time is longer when the main power supply operation unit is operated to be turned to the ON state, the resonance speed reach time being a time required to decrease the rotation speed of the anode from the operation speed to the resonance speed without activating the braking unit by inertia, and wherein the stop time determination unit activates the braking unit when it is determined that the resonance speed reach time is longer than the stop time to decrease the rotation speed of the anode to the braking speed.

* * * * *